US009993124B2

(12) United States Patent
Poleki

(10) Patent No.: US 9,993,124 B2
(45) Date of Patent: Jun. 12, 2018

(54) CLEANING TOILET SEATS

(71) Applicant: Robert T. Poleki, Pocatello, ID (US)

(72) Inventor: Robert T. Poleki, Pocatello, ID (US)

( * ) Notice: Subject to any disclaimer, the term of this patent is extended or adjusted under 35 U.S.C. 154(b) by 0 days. days.

(21) Appl. No.: 14/944,219

(22) Filed: Nov. 18, 2015

(65) Prior Publication Data

US 2017/0135537 A1 May 18, 2017

(51) Int. Cl.
*A47K 13/00* (2006.01)
*A47K 13/30* (2006.01)

(52) U.S. Cl.
CPC ..... *A47K 13/302* (2013.01)

(58) Field of Classification Search
USPC ..... 4/233
See application file for complete search history.

(56) References Cited

U.S. PATENT DOCUMENTS

| | | | | |
|---|---|---|---|---|
| 1,520,789 | A | 12/1924 | Weill | |
| 2,458,019 | A | 1/1949 | Niles | |
| 3,599,246 | A | 8/1971 | Bramati | |
| 3,837,018 | A | 9/1974 | Haberle | |
| 4,063,316 | A * | 12/1977 | Hunninghaus ..... | A47K 13/302 4/233 |
| 4,242,764 | A | 1/1981 | Fukuda | |
| 4,536,899 | A | 8/1985 | Schnyder | |
| 4,790,036 | A | 12/1988 | Vogeli et al. | |
| 5,022,097 | A | 6/1991 | Pusic | |
| 5,031,252 | A | 7/1991 | Oyama | |
| 5,119,517 | A | 6/1992 | Chang | |
| 5,504,946 | A | 4/1996 | Keshiro | |
| 5,564,134 | A | 10/1996 | Ruth | |
| 5,813,057 | A | 9/1998 | Descent | |
| 6,003,159 | A | 12/1999 | Sadegh et al. | |

(Continued)

FOREIGN PATENT DOCUMENTS

| | | | |
|---|---|---|---|
| EP | 0931497 | A3 | 5/2000 |
| EP | 1138240 | A1 | 10/2001 |
| WO | WO 2013015763 | A1 | 1/2013 |

OTHER PUBLICATIONS

Blueline Hygienics, The Eyegiene, Auto Sensor, European Designed Toilet Seat, http://www.bluelinehygienics.com/index.php-?pageid=2353 (accessed Feb. 17, 2016) see attch. for detail.

(Continued)

*Primary Examiner* — Lauren Crane
(74) *Attorney, Agent, or Firm* — Flaig Law Office, PLLC

(57) ABSTRACT

Toilet seat cleaning devices, methods and systems are described. Toilet seat cleaning systems may include a toilet, a toilet seat, a fluid dispenser and a flow way. Toilet seats may include at least one opening and at least one surface whereon fluids from a fluid dispenser may be communicated. Fluid dispensers may include a fluid container and a dispenser mechanism. Methods of using toilet seat cleaning systems may include a user influencing the activation of a dispenser mechanism; the dispenser mechanism influencing the communication of fluid from a fluid container to a flow way; the fluid being communicated through the flow way and out of at least one opening and onto at least one surface of a toilet seat; and the fluid on the at least one surface of the toilet seat being engaged by the user in order to clean the toilet seat.

17 Claims, 20 Drawing Sheets

(56) References Cited

U.S. PATENT DOCUMENTS

| | | | | |
|---|---|---|---|---|
| 6,622,315 | B1 * | 9/2003 | Feygin | A47K 13/30 4/223 |
| 7,028,346 | B2 | 4/2006 | Ermini | |
| 7,117,549 | B1 | 10/2006 | Hannigan | |
| 8,079,094 | B2 | 12/2011 | DiPano | |
| 8,365,317 | B1 | 2/2013 | Dorra | |
| 8,776,278 | B1 * | 7/2014 | Dorra | A47K 13/302 4/233 |
| 2006/0206997 | A1 | 9/2006 | Chiang | |
| 2009/0133185 | A1 | 5/2009 | Fisseha | |
| 2012/0227171 | A1 | 9/2012 | Lopez | |

OTHER PUBLICATIONS

PRWeb, CWS Cleanseat, http://www.prweb.com/releases/2005/06/prweb253629.htm (accessed Feb. 17, 2016), other details unknown or otherwise indicated on attachment.

PRWeb, CWS Clean Seat, http://www.prweb.com/releases/2003/05/prweb67565.htm (accessed Feb. 17, 2016), other details unknown or otherwise indicated on attachment.

Rema-Stersys, http://www.remastersys.com/sale/pz260b216-z1e2e769-clean-sense-dib-1500r-bidet-toilet-seat.html (accessed Feb. 17, 2016), see attachment for details.

Rema-Stersys, http://www.remastersys.com/images/toilet_seat_air_cleaner_ot_tac950-pz1955cde-zbf8af.html (accessed Feb. 17, 2016), see attachment for details.

Calfarme, Foam Care Toilet Seat Sanitizer, http://www.calfarme.com.sg/foamcaretoiletseatsanitizer.htm (accessed Feb. 17, 2016), see attachment for details.

Hygolet Direct, Seat Sanitizer Dispenser, http://www.hygoletdirect.com/p8/Seat-Sanitizer-Dispenser/product_info.html (accessed Feb. 17, 2016), see attachment for details.

Touch Free, Toilet Seat Wipes, http://www.touchfree.com/toilet-seat-wipes.html (accessed Feb. 17, 2016), other details unknown or otherwise indicated on attachment.

Zhuhai Kesai Export Co.,Ltd., Automatic Sensor Dispenser, http://kesai804.en.ec21.com/Automatic_Sensor_Dispenser--4182668.html (accessed Feb. 17, 2016), see attachment for details.

Asia.Ru, Toilet Seat Cover Dispenser, http://www.asia.ru/en/ProductInfo/647390.html (accessed Feb. 17, 2016), other details unknown or otherwise indicated on attachment.

alibaba.com, http://www.alibaba.com/product-detail/Automatically-Shower-Toilet-Seat-Sanitizer-Dispenser_60221975215.html (accessed Feb. 17, 2016), see attachment for details.

Xiamen Wing Technology Co. Ltd, Wing Hygiene Heated Toilet Seat, Suitable for Hotels, Office Buildings and Restaurants, see attachment for details.

alibaba.com, Search Terms: "automatic toilet seat cover", http://www.alibaba.com/showroom/automatic-toilet-seat-cover.html (accessed Feb. 17, 2016), see attachment for details.

Bella Bagno Inc., Hygolet Sanitary Toilet Seat, http://www.bellabagno.com/ (accessed Feb. 17, 2016), other details unknown or otherwise indicated on attachment.

Brill Hygienic Products, Inc., Auto toilet seat covers, http://www.brillseat.com/ (accessed Feb. 17, 2016), other details unknown or otherwise indicated on attachment.

Google, Kohler K-4108-0 C3 230 elongated bidet toilet seat with in-line heater and touchscreen remote control—White, see attachment for details.

Ordor-Z-Way, Adjustable Advantage Toilet Seat, http://www.odorzway.com/html/adjustableadvantage.htm (accessed Feb. 17, 2016), see attachment for details.

Waxie Sanitary Supply, http://info.waxie.com/blog/bid/110659/Public-Toilet-Seat-Sanitizers-Do-They-Work-or-Is-It-Peace-of-Mind (accessed Feb. 17, 2016), see attch. for details.

alibaba.com, Hygienic Duroplast Toilet Seat, http://www.alibaba.com/product-detail/hygienic-duroplast-Toilet-Seat_322908568.html (accessed Feb. 17, 2016), see attch. for details.

Aliexpress, Search Terms "Toilet Hygiene," http://www.aliexpress.com/cheap/cheap-toilet-hygiene.html (accessed Feb. 17, 2016), see attachment for details.

* cited by examiner

CLEANING TOILET SEATS

BACKGROUND

Technical Field

The disclosure relates at least to cleaning toilet seats.

Discussion of Related Field

People desire to use a clean toilet seat when they go to the bathroom. Whether in the residential or commercial setting, children and other people may not clean up the toilet seat after they use it. As a result, the next user is left with the dirty task of cleaning up another person's mess. Such an experience is not pleasant or sanitary.

Efforts have been made to assist people in obtaining clean toilet seats. However, there may be a need for improved devices, methods and systems for cleaning toilet seats which may include at least one toilet seat comprising at least one opening and at least one surface whereon fluids may be communicated so that a user may easily clean the toilet seat prior to and/or after use.

SUMMARY

In one aspect a toilet seat may include: at least one surface; and at least one opening configured on the at least one surface; wherein a flow way may be configured from the at least one opening to a fluid dispenser; and wherein the flow way may be configured to facilitate the flow of fluid from the fluid dispenser, through the flow way and out of the at least one opening and on to the at least one surface.

Implementations may include one or more of the following features. The toilet seat may include at least two openings configured on the at least one surface. The toilet seat may include a compartment and a compartment door. The toilet seat may include a channel.

In another aspect a toilet seat cleaning system may include: a toilet; a toilet seat comprising at least one surface and at least one opening configured on the at least one surface; a fluid dispenser; and a flow way; wherein the flow way is configured from the at least one opening to the fluid dispenser; and wherein the flow way is configured to facilitate the flow of fluid from the fluid dispenser, through the flow way and out of the at least one opening and on to the at least one surface.

Implementations may include one or more of the following features. The fluid dispenser may be an external fluid dispenser. The fluid dispenser may be an internal fluid dispenser. The fluid dispenser may be configured to contain at least 200 mL of fluid. The fluid dispenser may be configured to communicate with a sensor. The fluid dispenser may be configured with a sensor. The fluid dispenser may be activated by at least one manual operation performed by a user. The fluid container may be configured to be replaceable. The fluid container may be configured to be refillable. The flow way may include at least one tubing member. The flow way may include at least one external tubing member; at least one connector member; at least one internal tubing member; and at least one nozzle. The flow way may include at least one internal connector tubing member; at least one connector member; at least one internal tubing member; and at least one nozzle. The toilet seat cleaning system may be used in conjunction with a toilet configured for commercial settings. The toilet seat cleaning system may be used in conjunction with a toilet configured for residential settings. The toilet seat cleaning system may be used in conjunction with a portable toilet system.

In another aspect a method of using a toilet seat cleaning system may include: a user; a toilet; a toilet seat comprising at least one surface and at least one opening configured on the at least one surface; a fluid dispenser comprising a fluid container and a dispenser mechanism; and a flow way; wherein the flow way is configured from the at least one opening to the fluid dispenser; and wherein the flow way is configured to facilitate the flow of fluid from the fluid dispenser, through the flow way and out of the at least one opening and on to the at least one surface; and the user influencing the activation of the dispenser mechanism; the dispenser mechanism influencing the communication of the fluid from the fluid container to the flow way; the fluid being communicated through the flow way and out of at least one opening and onto at least one surface of the toilet seat; and the fluid on the at least one surface of the toilet seat being engaged by the user in order to clean the toilet seat.

These general and specific aspects may be implemented by using systems, apparatuses, devices, means, methods and structures or any combination thereof.

Certain implementations may provide one or more of the following advantages. Embodiments may not achieve any or all of the listed advantages. Further, this is not an exhaustive list of all possible advantages of the disclosure. One or more embodiments of the disclosure may be configured to be and/or provide users the following.

In one or more embodiments, the disclosure may be configured to be user friendly and quick and easy to use; provide a disinfected, clean and/or dry surface to sit on; allow for less risk of contact with germs, bacteria and/or disease; and/or provide peace of mind and/or comfort when using a public toilet seat.

Other features and advantages may be apparent from the following detailed description, the accompanying drawings, and the claims.

BRIEF DESCRIPTION OF THE DRAWINGS

Various embodiments of the disclosure will now be discussed with reference to the appended drawings. It is appreciated that these drawings depict only typical embodiments of the disclosure and are not to be considered limiting of its scope.

DETAILED DESCRIPTION

Figure 1:
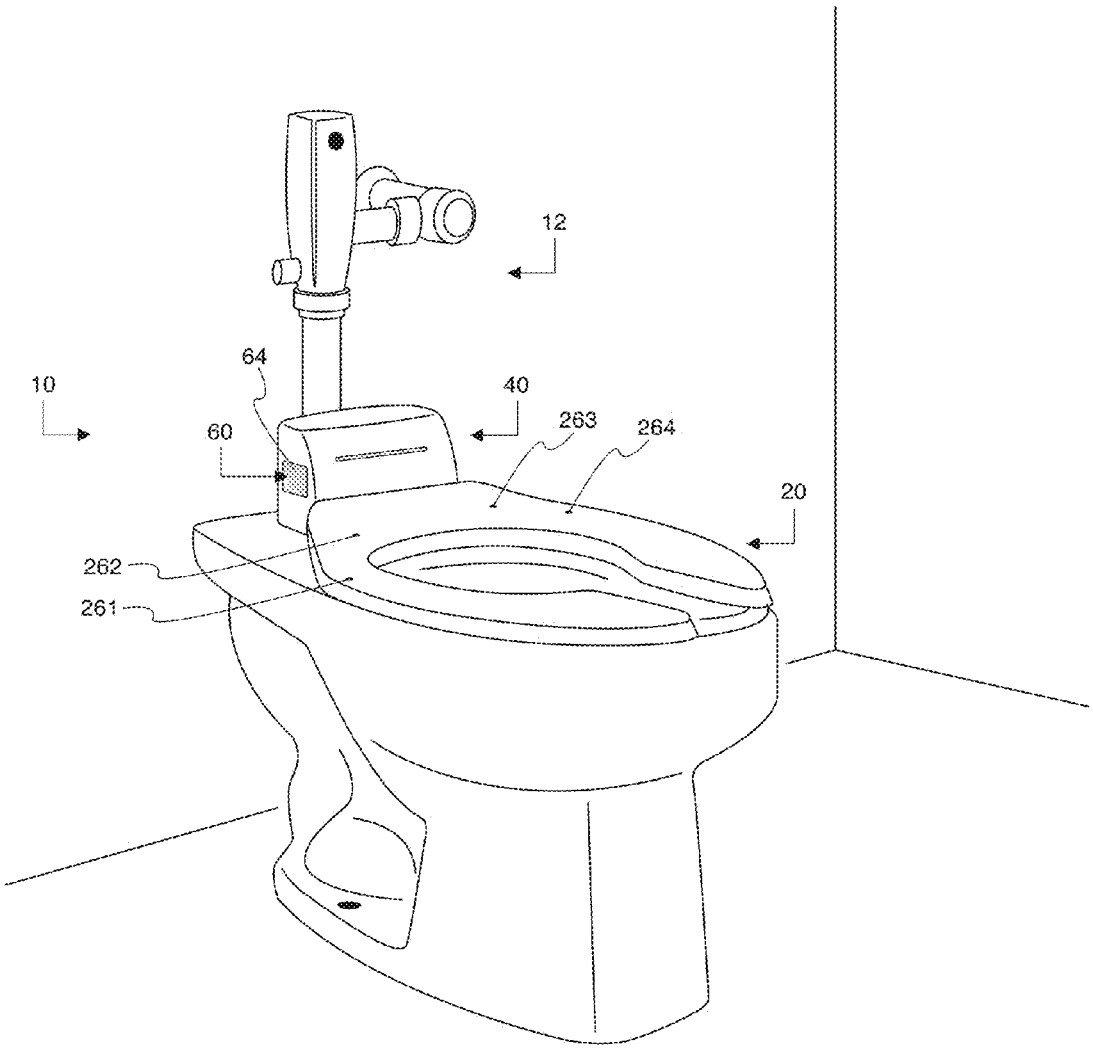
FIG. 1 shows a perspective view of one embodiment of a toilet seat cleaning system which may include a toilet, a toilet seat, an external fluid dispenser and a flow way (not shown in FIG. 1)

The following description illustrates principles of the disclosure which may be applied in various ways to provide different embodiments. There may be many different forms of embodiments of the disclosure, and as such, embodiments should not be limited to those set forth herein and shown in the accompanying drawings. While exemplary embodiments of the disclosure may be shown and described herein, changes and modifications may be made without departing from its scope and concepts. That which is set forth herein and shown in the accompanying drawings is offered to illustrate the principles of the disclosure and one or more embodiments, and not as limitations. Other variations of the disclosure may be included within the principles of the disclosure.

In one or more embodiments, regardless of whether expressly stated herein or illustrated in the accompanying drawings, the disclosure may be configurable, adaptable and customizable to meet the various needs of various users in various circumstances and/or to be compatible and/or used in conjunction with various systems, apparatuses, articles, devices, means, methods and structures.

In one or more embodiments, the disclosure may be configured in various ways, by various means and/or methods, with various parts, to various dimensions (such as, for example, but limited to shapes and/or sizes) and/or with various materials. For example, in one or more embodiments, the specific parts, materials, members, devices, systems and/or components of the disclosure may be configured together, separate and/or with other materials, members, devices, systems and/or components and/or combinations thereof.

In one or more embodiments, the disclosure may be used for various uses and/or for various purposes. In one or more embodiments, the drawings herein may but do not necessarily illustrate the disclosure to scale. In one or more embodiments, the drawings herein may but do not necessarily depict the exact positions, sizes, shapes, sizes, layouts, designs, angles and/or other dimensions and/or configurations in which the disclosure may be implemented.

In one or more embodiments, each description of the disclosure expressly and inherently described and illustrated herein, may be implemented in no, one or more than one embodiment.

In one or more embodiments, the disclosure may include a toilet seat cleaning system 10. In one or more embodiments, toilet seat cleaning system 10 may include a toilet, a toilet seat, a fluid dispenser, and a flow way. In one or more embodiments, the toilet seat may include at least one opening and at least one surface. In one or more embodiments, the fluid dispenser may include the capacity to contain and communicate fluid. In one or more embodiments, the flow way may be configured to allow fluid to flow from the fluid dispenser and ultimately out of the toilet seat's at least one opening and on to the toilet seat's at least one surface.

In one or more embodiments, one or more aspects of toilet seat cleaning system 10 (including, for example, but not limited to the toilet, the toilet seat, the fluid dispenser, and/or the flow way) may vary greatly and be composed of various parts, materials, configurations (including, for example, but not limited to various shapes, sizes, colors and/or other dimensions and/or characteristic), aspects, features and functionalities, and/or for various reasons (including, for example, but not limited to the advantages listed in the Summary section of this application), whether illustrated in the drawings or not and whether available at the time of filing or hereafter discovered. All such variations are contemplated herein and may implement the principles of the disclosure. In one or more embodiments, one or more aspects of toilet seat cleaning system 10 may be configured using one or more materials or a combination thereof. In one or more embodiments, the material(s) may possess various strengths, elasticities, weights, thicknesses, lengths, widths, heights, angles, heights, colors, shapes, sizes, textures, layers, surfaces, finishes and the like and other characteristics and/or dimensions and/or combinations thereof. In one or more embodiments, one or more aspects of toilet seat cleaning system 10 may be configured in various ways (including, for example, but not limited to being configured together and/or separate), including, for example, but not limited to the following: welding, melting, burning, gluing, cementing, screwing, fitting, snapping, clamping, clipping, pining and the like or other materials, adhesives, devices, systems, means, and methods, and/or combinations thereof. In one or more embodiments, the material(s) used to configure and the manner in which one or more aspects of toilet seat cleaning system 10 may be configured to meet applicable laws, standards, rules, regulations, tests and/or requirements. In one or more embodiments, one or more aspects of toilet seat cleaning system 10 may be custom manufactured and/or provided by various manufactures (such as, for example, but not limited to Crane Plumbing Corporation, Toto Ltd., Kohler, etc.) and/or by Applicant and/or in combination thereof. In one or more embodiments, various implementations of toilet seat cleaning system 10 may be configured to be used in a variety of environments or settings such as, for example, but not limited to residential settings and/or commercial or public settings (such as, for example, but not limited to hotels, businesses, schools, universities, hospitals, restaurants, community centers, libraries, shopping malls, sport arenas and stadiums, parks, rest stops, trains, planes, ships and the like and other places and facilities). Other aspects of various embodiments of toilet seat cleaning system 10 may be described and/or illustrated herein.

Figure 7A:
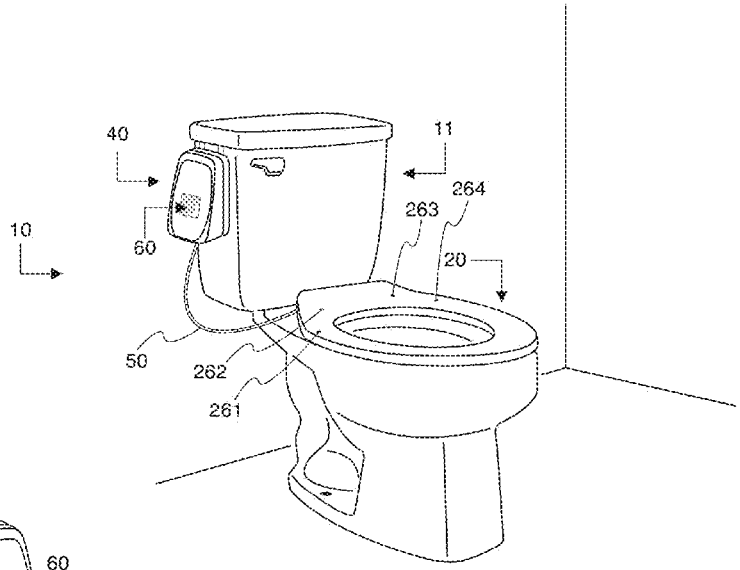
FIG. 7A shows one embodiment of a toilet seat cleaning system which may include a toilet, a toilet seat, an external fluid dispenser and a flow way.
Figure 7B:
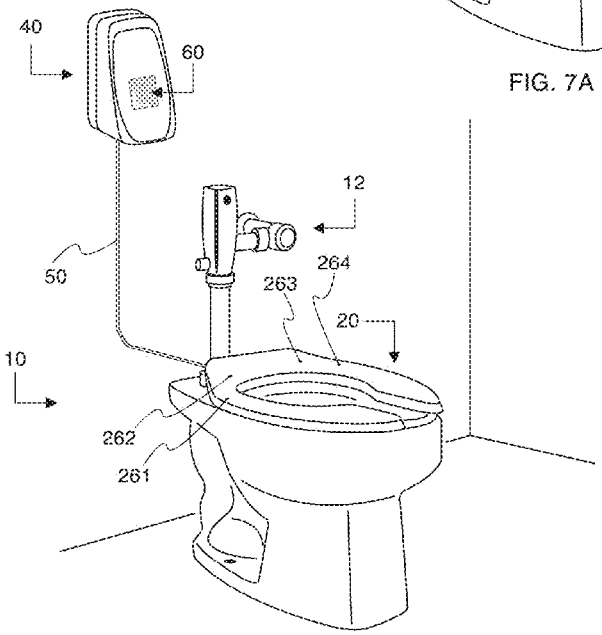
FIG. 7B shows one embodiment of a toilet seat cleaning system which may include a toilet (different than that which is illustrated in FIG. 7A), a toilet seat, an external fluid dispenser and a flow way.
Figure 7C:
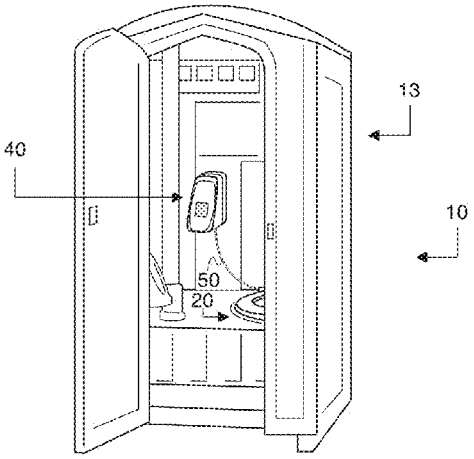
FIG. 7C shows one embodiment of a toilet seat cleaning system which may include a toilet (different than that which is illustrated in FIGS. 7A and 7B), a toilet seat, an external fluid dispenser and a flow way.
Figure 12A:
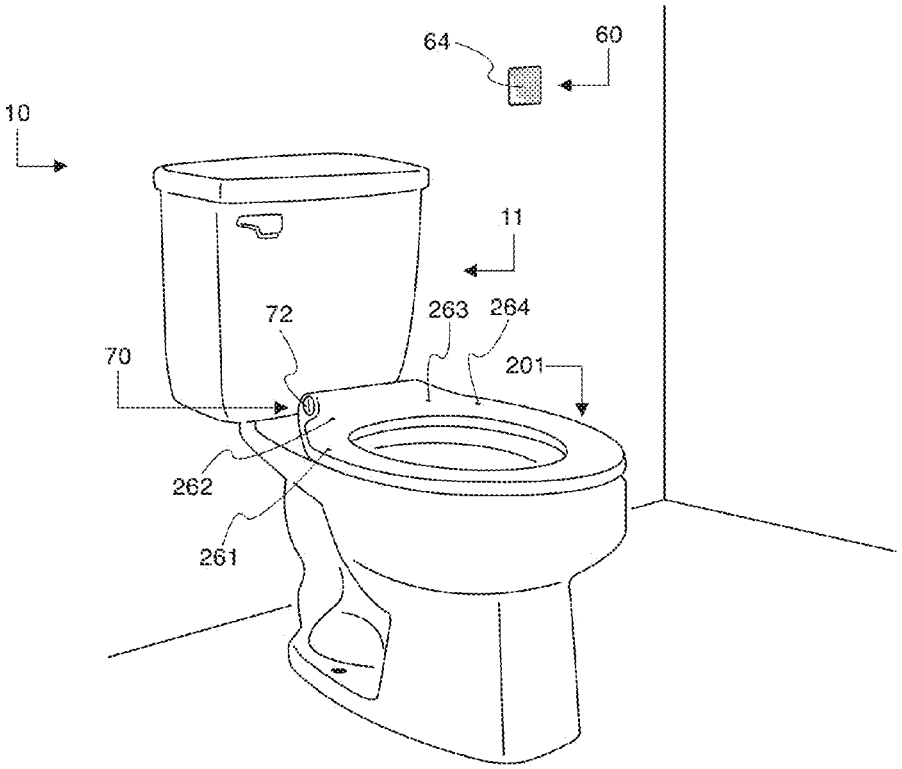
FIG. 12A shows one embodiment of a toilet seat cleaning system which may include a toilet, a toilet seat, an internal fluid dispenser (not shown in FIG. 12A), a cap, and a sensor.
Figure 12B:
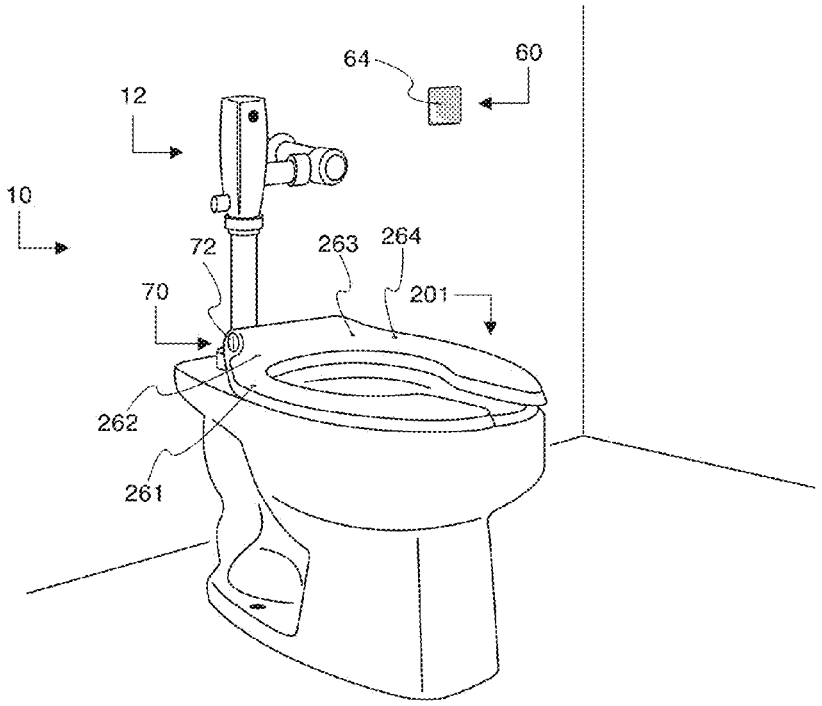
FIG. 12B shows one embodiment of a toilet seat cleaning system which may include a toilet (different than the toilet illustrated in FIG. 12B), a toilet seat, an internal fluid dispenser (not shown in FIG. 12B), a cap, and a sensor.

In one or more embodiments, the toilets that may be included in toilet seat cleaning system 10 may vary greatly and be composed of various parts, materials, configurations (including, for example, but not limited to various shapes, sizes, colors and/or other dimensions and/or characteristics), aspects, features and functionalities, whether illustrated in the drawings or not and whether available at the time of filing or hereafter discovered. All such variations are contemplated herein and may implement the principles of the disclosure. For example, FIGS. 7A and 12A show embodiments of toilet seat cleaning system 10 which may include a toilet 11 that may be used in a residential setting and which may include a conventional tank, toilet bowel and other parts associated with such a system; FIGS. 1, 7B and 12B show embodiments of toilet seat cleaning system 10 which may include a toilet 12 that may be used in a commercial setting and which may include tankless functionality, a toilet bowel and other parts associated with such a system; and FIG. 7C shows one embodiment of toilet seat cleaning system 10 which may include a toilet 13 that may be used with a portable toilet system (such as, for example, but not limited to a Porta-Potty, etc.) and that may include parts associated with such a system. Other aspects of various embodiments of toilets may be described and/or illustrated herein.

In one or more embodiments, the toilet seats (such as, for example, but not limited to toilet seats 20 and 201) that may be included in toilet seat cleaning system 10 may vary greatly and be composed of various parts, materials, configurations (including, for example, but not limited to various shapes, sizes, colors and/or other dimensions and/or characteristics), aspects, features and functionalities, whether illustrated in the drawings or not and whether available at the time of filing or hereafter discovered. All such variations are contemplated herein and may implement the principles of the disclosure. For example, in one or more embodiments, the toilet seats may be configured to match the style of the toilet and fit the shape of the toilet bowl. In one or more embodiments, the toilet seats may be configured with or without a lid or cover. In one or more embodiments, the toilet seats may be configured with an open front (such as, for example, but not limited to as illustrated in FIGS. 1, 7B and 12B) or with an enclosed front (such as, for example, but not limited to as illustrated in FIGS. 7A and 12A). In one or more embodiments, the toilet seats may be configured for ergonomic purposes and/or to accommodate various disabilities and handicaps. In one or more embodiments, the toilet seats may be configured to various shapes and with various surface angles. In one or more embodiments, the toilet seats may be configured with noise reducing and slow-closing hinge functionality. In one or more embodiments, the toilet seats may be configured from wood, plastic, metal, alloy and the like or other materials or combinations of materials. In one or more embodiments, the toilet seats may be configured with various cushions, decorative art and/or textile. In one or more embodiments, the toilet seats may be configured with heating capabilities, drying capabilities (such as, for example, but not limited to a blow drier), bidet capabilities and/or other parts and functionalities. In one or more embodiments, the toilet seats may include at least one opening through which various fluids may be communicated. In one or more embodiments, the various fluids may be communicated through the at least one openings and onto at least one surface of the toilet seat. Other aspects of various embodiments of toilet seats may be described and/or illustrated herein.

In one or more embodiments, the at least one opening (such as, for example, but not limited to openings 261, 262, 263 and 264) that may be included in the toilet seats may vary greatly and be composed of various parts, materials, configurations (including, for example, but not limited to various shapes, sizes, colors and/or other dimensions and/or characteristics), aspects, features and functionalities, whether illustrated in the drawings or not and whether available at the time of filing or hereafter discovered. All such variations are contemplated herein and may implement the principles of the disclosure. In one or more embodiments, the size of the at least one opening may vary. For example, in one or more embodiments, the diameter of the at least one opening may be between about 1/144 of an inch to about 1 inch. In one or more embodiments, the diameter of the at least one opening may be between about 1/32 of an inch to about 1/8 of an inch (such as, for example, but not limited to about 1/16 of an inch). In one or more embodiments, it is anticipated that the disclosure may include one or more openings, such as, for example, but not limited to one, two, three, four, five, six, seven, eight, nine, ten, eleven, twelve, thirteen, fourteen, fifteen, sixteen, seventeen, eighteen, nineteen, twenty or more openings. In one or more embodiments, the at least one opening may be made by means of drilling, pressing, sawing, cutting or other means. In one or more embodiments, none or at least one of the openings may be configured to be substantially the same and/or different sizes, shapes, diameters and/or other dimensions or characteristics as compared to the other openings (provided that more than one opening is provided).

In one or more embodiments, the fluid dispensers (such as, for example, but not limited to external fluid dispenser 40 and internal fluid dispenser 70) that may be included in toilet seat cleaning system 10 may vary greatly and be composed of various parts, materials, configurations (including, for example, but not limited to various shapes, sizes, colors and/or other dimensions and/or characteristics), aspects, features and functionalities, whether illustrated in the drawings or not and whether available at the time of filing or hereafter discovered. All such variations are contemplated herein and may implement the principles of the disclosure. For example, in one or more embodiments, at least one aspect of the fluid dispensers may be configured to be separate from the toilet seat (such as, for example, but not limited to external fluid dispenser 40). In one or more embodiments, fluid dispensers may be configured to the toilets (such as, for example, but not limited to as shown in FIGS. 1 and 7A), on a wall or fixture near the toilets (such as, for example, but not limited to as shown in FIGS. 7B and 7C) and/or on some other location proximal to whatever toilet is included in the disclosure. In one or more embodiments, at least one aspect of the fluid dispensers may be configured to be built into the toilet seat (such as, for example, but not limited to internal fluid dispenser 70). In one or more embodiments, at least one aspect of the fluid dispensers may be removable and/or non-removable from the toilet seat. In one or more embodiments, fluid dispensers may be obtained and/or modified from existing technology. For example, U.S. Pat. No. 5,492,247 A (entitled "Automatic Soap Dispenser"), U.S. Pat. No. 6,206,241 B1 (entitled "Automatic Fluid Dispenser"), and U.S. Pat. No. 5,611,465 (entitled "Automatic Toilet Bowl Cleaner") illustrate a variety of automatic soap dispensers and U.S. Pat. No. 4,886,192 A (entitled "Liquid soap dispenser"), U.S. Pat. No. 4,493,440 A (entitled "Wall-mounted soap dispenser") and U.S. Pat. No. 8,584,904 B2 (entitled "Liquid soap dispenser for dispensing a mixture of a dish cleaning liquid soap and water") illustrate a variety of manually operated soap dispensers. In one or more embodiments, the elements, principles, structures, techniques, and methods of the aforementioned patents may be combined in any manner with any of the elements, principles, structures, techniques, and methods of the present disclosure. All of the subject matter and disclosures of the aforementioned patents are incorporated herein by reference in their entirety. In one or more embodiments, fluid dispensers may be obtained and/or modified from various retailers and/or manufactures, such as, for example, but not limited to GoJo, Purell, CVS, Bath & Body Works, Germ X, Walgreens, Coloplast and the like or other retailers and/or manufactures. In one or more embodiments, modifications to existing fluid dispensers may include modifying them so that fluid may be communicated out of the fluid dispensers through a flow way so fluid that would conventionally drop directly onto a user's hand would instead be communicated from the fluid dispenser, through a flow way and ultimately out of at least one opening and onto at least one surface of a toilet seat.

In one or more embodiments, fluid dispensers may be configured to various dimensions. For example, in one or more embodiments, fluid dispensers may be configured to be between about 1 inch to about 48 inches wide, between about ¼ of an inch to about 36 inches deep and between about 1 inch to about 72 inches long. In one or more embodiments, fluid dispensers may be configured to about 8 inches wide, about 4 inches deep, and about 3 and ½ inches long. In one or more embodiments, fluid dispensers may be configured to about 5 inches wide, about 4 inches deep, and about 12 inches long. In one or more embodiments, fluid dispensers may be configured to about 6 inches long and between about ¼ of an inch to about 12 inches in diameter (such as, for example, but not limited to about 2 inches in diameter)

In one or more embodiments, fluid dispensers may be configured in various ways and with various parts. In one or more embodiments, fluid dispensers may include none, one or at least one of the following parts: at least one cover (such as, for example, but not limited to cover 42); a fluid container (such as, for example, but not limited to fluid containers 45 or 451); at least one base plate (such as, for example, but not limited to base plate 47); at least one dispenser mechanism (such as, for example, but not limited to dispenser mechanisms 48 or 481); at least one power source (such as, for example, but not limited to power sources 49 or 491); at least one sensor (such as, for example, but not limited to sensor 60); and/or other components (such as, for example, but not limited to a pump, an actuation tip, a LED indicator, a fluid indicator, values, washers, tubes, hinges, locks, caps, screws, batteries, and the like or other and additional parts).

In one or more embodiments, fluid containers (such as, for example, but not limited to fluid containers 45 and 451) may include various configurations. For example, in one or more embodiments, fluid containers may include a cartridge, a bladder, a tank and/or the like or other configurations which may contain and be capable of communicating fluid. In one or more embodiments, the fluid container may be refillable, replaceable, reusable and/or disposable. In one or more embodiments, fluid containers may be configured to hold various amounts of fluid and with various capacities. For example, in one or more embodiments, fluid containers may be configured to hold between about 5 mL to about 50,000 mL of fluid. In one or more embodiments, fluid containers may be configured with the capacity and filled with enough fluid to provide at least 10 wipes before refilling and/or replacement is necessary. In one or more embodiments, fluid containers may be configured to hold between about 900 mL to about 3,000 mL of fluid. In one or more embodiments, fluid containers may be configured with the capacity and filled with enough fluid to provide at least between about 1,000 to about 4,000 wipes before refilling and/or replacement is necessary. In one or more embodiments, fluid containers may be configured to hold between about 200 mL to about 1,500 mL of fluid. In one or more embodiments, fluid containers may be configured with the capacity and filled with enough fluid to provide at least between about 100 to about 2,000 wipes before refilling and/or replacement is necessary.

In one or more embodiments, the fluids (such as, for example, but not limited to fluid 90) which may be contained and be capable of being communicated by the fluid containers (and/or otherwise included in toilet seat cleaning system 10) may vary greatly and be composed of various substances, chemicals, mixtures, properties, features and functionalities, whether illustrated in the drawings or not and whether available at the time of filing or hereafter discovered. All such variations are contemplated herein and may implement the principles of the disclosure. For example, in one or more embodiments, the fluids may include liquid, gel, foam and/or the like or other fluids and substances thereof. In one or more embodiments, the fluids may include hand sanitizers, disinfectants, antiseptics, antimicrobial agents, antibacterial substances, iodine, soaps, alcohols, rubbing alcohols, sterilizers, water, chlorine and the like or other substances and/or combinations thereof. In one or more embodiments, the fluids may be comprised of various percentages of substances. For example, the fluids may be configured to contain between about 0.0 percent to about 100 percent alcohol (such as, for example, but not limited to about 70 percent alcohol). In one or more embodiments, the fluids may be self-drying or non-self-drying. In one or more embodiments, the fluids used in the process of cleaning the toilet seats may disinfect, sterilize, clean, and/or sanitize the toilet seats and/or assist in reducing and/or eliminating harmful and/or unwanted substances (such as, for example, but not limited to bacteria, viruses, diseases, waste and the like or other substances). In one or more embodiments, the fluids may be provided by various manufacturers and/or retailers, such as, for example, but not limited to Purell, ABC Compounding Co., Inc., American Sales Company, etc.

In one or more embodiments, dispenser mechanisms (such as, for example, but not limited to dispenser mechanisms 48 and 481) may be activated by a user (such as, for example, but not limited to via a user's manual operations, such as, for example, but not limited to squeezing, pumping, pushing, pulling, pressing, pinching, shaking, and/or other manual operations) which may influence fluid being communicated out of a fluid dispenser (such as, for example, but not limited to external fluid dispenser 40 or internal fluid dispenser 70) and ultimately out of at least one opening (such as, for example, but not limited to openings 261, 262, 263 and 264) and onto at least one surface (such as, for example, but not limited to top surfaces 22 or 221) of a toilet seat (such as, for example, but not limited to toilet seat 20 or 201). In one or more embodiments, dispenser mechanisms may be activated by at least one sensor (such as, for example, but not limited to sensor 60) which, when activated, may initiate electronical signals or other communications which may trigger mechanical actions which may influence fluid being communicated out of a fluid dispenser (such as, for example, but not limited to external fluid dispenser 40 or internal fluid dispenser 70) and ultimately out of at least one opening (such as, for example, but not limited to openings 261, 262, 263 and 264) and onto at least one surface (such as, for example, but not limited to top surfaces 22 or 221) of a toilet seat (such as, for example, but not limited to toilet seat 20 or 201). In one or more embodiments, fluid dispensers may be configured to use foam soap as a type of fluid which use may require dual pump mechanisms to move air and fluid through the system.

In one or more embodiments, sensors (such as, for example, but not limited to sensor 60) may include touchless technology that detects the presence of a user's hand or other appendages or object within a detectable range of the sensors. In one or more embodiments, the means by which said detection occurs may be accomplished by various means, such as, for example, but not limited to the sensors may use infrared signals so that when a user's hand or other appendage or object comes within a certain distance (such as, for example, but not limited to less than 25 feet) of the sensors an infrared signal may bounce off the user's hand or other appendage or object and may be detected by the sensors. In one or more embodiments, once the sensors detect the user's or object's presence it may send a signal to a dispenser mechanism which may influence the process by which fluid may be communicated onto at least one surface of a toilet seat. In one or more embodiments, ultrasonic fields or other signals or detection means may be used instead of and/or in addition to infrared signals. In one or more embodiments, the circuitry, hardware and software components associated with the sensors may be adapted and/or configured as necessary in order to make the touchless technology work. In one or more embodiments, the sensors may include wireless technology and/or wires or other means and/or combinations thereof which may communicate with other aspects of toilet seat cleaning system 10. In one or more embodiments, the sensors may be configured to fluid dispensers (such as, for example, but not limited to as illustrated in FIGS. 1, 7A, 7B and 7C), on the toilet, a proximal wall or fixture (such as, for example, but not limited to as illustrated in FIGS. 12A and 12B), and/or some other location proximal to toilet seat cleaning system 10. In one or more embodiments, the sensors may be configured to fluid dispensers by various means, methods and materials, such as, for example, but not limited to screws, soldering, bolts, nails, glues, ties, or other or the like means, methods, adhesives and materials. In one or more embodiments, the sensors may be releaseably configured or non-releaseably configured to fluid dispensers. In one or more embodiments, the sensors may be configured to various dimensions, such as, for example, but not limited to in substantially square form (as illustrated in the drawings herein), circle form, triangular form and/or any other form, in any width, height, length, shape, diameter and/or other configuration.

In one or more embodiments, sensors may be obtained and/or modified from existing technology. For example, U.S. Patent Application Numbers 20140123378 A1 (entitled, "Touchless flushing systems and methods"), 20140259337 A1 (entitled "Automatic hygienic toilet seat with wireless proximity sensor and controller"), and 20120293404 A1 (entitled, "Low Cost Embedded Touchless Gesture Sensor") illustrate a variety of aspects of sensors. In one or more embodiments, the elements, principles, structures, techniques, and methods of the aforementioned patent applications may be combined in any manner with any of the elements, principles, structures, techniques, and methods of the present disclosure. All of the subject matter and disclosures of the aforementioned patent applications are incorporated herein by reference in their entirety. In one or more embodiments, sensors may be obtained and/or modified from various retailers and/or manufactures.

In one or more embodiments, power sources (such as, for example, but not limited to power sources 49 and 491) may include batteries of various shapes, sizes, types, capacities and/or other dimensions and/or characteristics. For example, in one or more embodiments, the batteries may include AA, AAA, AAAA, A23, 4.5-volt, D, C, 9-volt, CR2032, LR44, and the like and other configurations, including rechargeable batteries or non-rechargeable batteries. In one or more embodiments, power sources may be capable of being plugged into and receive energy from an electrical power source.

Other aspects of various embodiments of fluid dispensers may be described and/or illustrated herein.

In one or more embodiments, the flow ways that may be included in toilet seat cleaning system 10 may vary greatly and be composed of various parts, materials, configurations (including, for example, but not limited to various shapes, sizes, colors and/or other dimensions and/or characteristics), aspects, features and functionalities, whether illustrated in the drawings or not and whether available at the time of filing or hereafter discovered. All such variations are contemplated herein and may implement the principles of the disclosure. For example, in one or more embodiments, a flow way may include none, one or at least one of the following aspects: at least one external tubing member (such as, for example, but not limited to external tubing member 50); at least one internal tubing member (such as, for example, but not limited to internal tubing members 281, 282, 283 and 284); at least one nozzle (such as, for example, but not limited to nozzles 301, 302, 303 and 304); at least one connector member (such as, for example, but not limited to connector member 39); at least one internal connector tubing member (such as, for example, but not limited to internal connector tubing member 51); and/or other aspects.

In one or more embodiments, the configuration of the various aspects of flow way may vary. For example, in one or more embodiments, each internal tubing member may be configured to at least one nozzle and each nozzle may be configured to at least one opening. In one or more embodiments, each internal tubing member may be configured to at least one connector member. In one or more embodiments, each connector member may be configured to at least one external tubing member. In one or more embodiments, each external tubing member may be configured to a fluid dispenser (such as, for example, but not limited to an external fluid dispenser 40). In one or more embodiments, each connector member may be configured to at least one internal connector tubing member. In one or more embodiments, each internal connector tubing member may be configured to a fluid dispenser (such as, for example, but not limited to an internal fluid dispenser 70). In one or more embodiment, the flow way may include one or more tubing members which may be configured to a fluid dispenser and a nozzle. For example, the flow way may include an external tubing member 50 which may be configured to a fluid dispenser and at least one nozzle, without a connector member or internal tubing members.

In one or more embodiments, the number of external tubing members, internal tubing members, nozzles, connector members, internal connector tubing members and/or other aspects of the flow way may vary depending on the number of openings the toilet seat may be configured with and/or other factors and/or reasons. For example, in one or more embodiments, the flow way may be configured with one, two, three, four, five, six, seven, eight, nine, ten, eleven, twelve, thirteen, fourteen, fifteen, sixteen, seventeen, eighteen, nineteen, twenty or more external tubing members, internal tubing members, nozzles, connector members, internal connector tubing members and/or other aspects. In one or more embodiments, the number of external tubing members, internal tubing members, nozzles, connector members, internal connector tubing members and/or other aspects may be the same and/or different.

In one or more embodiments, the at least one external tubing member, at least one internal tubing member and/or at least one internal connector tubing member may be configured from the same or different tubing. For example, in one or more embodiments, the tubing may include but not be limited to the following: vinyl, plastic, acrylic, polyvinyl chloride (PVC), polyethylene, polypropylene, polyurethane, rubber, latex, nylon, silicone and the like and other materials and/or combinations thereof (such as, for example, but not limited to clear vinyl plastic tubing). In one or more embodiments, the tubing may be obtained from various manufactures and be of various types, such as, for example, but not limited to Bev-A-Line tubing, Excelon tubing, Flexelene™ tubing, K-Flex tubing, Viton® fluoroelastomer tubing, fluoropolymer tubing (such as, for example, but not limited to PTFE, PVDF, PFA, & FEP), Norprene® tubing, Excelprene tubing, Santoprene™ tubing, Tygon® tubing, Versilon™ tubing, and the like or other manufactures and/or materials and/or combinations thereof.

In one or more embodiments, various aspects of the at least one external tubing member, at least one internal tubing member and/or at least one internal connector tubing member may be configured to various dimensions. For example, in one or more embodiments, the at least one external tubing member, at least one internal tubing member and/or at least one internal connector tubing member may be configured to be between about 1/32 of an inch to about 25 feet in length. In one or more embodiments, the at least one external tubing member, at least one internal tubing member and/or at least one internal connector tubing member may be configured to be about 3 inches to about 12 inches in length. In one or more embodiments, the interior (or inside) diameter of the at least one external tubing member, at least one internal tubing member and/or at least one internal connector tubing member may be configured to be between about 1/32 of an inch to about 4 inches (such as, for example, but not limited to about 1/8 of an inch). In one or more embodiments, the exterior (or outside) diameter of the at least one external tubing member, at least one internal tubing member and/or at least one internal connector tubing member may be configured to be between about 1/32 of an inch to about 4 inches (such as, for example, but not limited to about 1/4 of an inch). In one or more embodiments, each or some of the at least one external tubing member, at least one internal tubing member and/or at least one internal connector tubing member may be configured to the same and/or different dimensions.

In one or more embodiments, the at least one nozzle (such as, for example, but not limited to nozzles 301, 302, 303 and 304) may be configured to various dimensions and various types and/or combinations thereof. For example, in one or more embodiments, the at least one nozzle may include in-line drippers (1 GPH), micro sprays or fogger misters (5-7 GPH, 360 degree pattern) and the like and others types of nozzles. In one or more embodiments, the at least one nozzle may be of various configurations. For example, in one or more embodiments, the at least one nozzle may be configured to the at least one internal tubing member. In one or more embodiments, the at least one nozzle may be configured to at least one opening or other aspects of toilet seat cleaning system 10. In one or more embodiments, the at least one nozzle may be configured to aspects of toilet seat cleaning system 10 by various means, such as, for example, but not limited to glue, melting, cementing, adhering, pressing, cutting, lasering, snapping, fastening, clamping, hooking, attaching, securing, connecting, pinching, cleaving, clinging, clasping, latching, welding, bolting, screwing, sticking, fitting, sliding, and the like and other materials, adhesives, devices, systems, means, and methods, and/or combinations. In one or more embodiments, such configurations may be releasable and/or not releasable.

In one or more embodiments, the at least one connector member may be configured to various dimensions and various types and/or combinations thereof. In one or more embodiments, the at least one connector member may include various configurations. For example, in one or more embodiments, the at least one connector member may include one or more ends or ports that may be configured to other aspects of the toilet seat cleaning system 10. For example, in one or more embodiments, one port(s) of the at least one connector member may be configured to at least one internal tubing member and another port(s) of the at least one connector member may be configured to the at least one external tubing member. In one or more embodiments, one port of at least one connector member may be configured to at least one internal tubing member and another port of the at least one connector member may be configured to the at least one internal connector tubing member.

Other aspects of various embodiments of flow ways may be described and/or illustrated herein.

FIG. 1 shows a perspective view of one embodiment of toilet seat cleaning system 10 which may include toilet 12, a toilet seat 20, an external fluid dispenser 40 and a flow way (not shown in FIG. 1). In one or more embodiments, toilet seat 20 may include openings 261, 262, 263 and 264 (although four openings are shown in FIG. 1 more or less openings may be provided) and at least one surface. In one or more embodiments, external fluid dispenser 40 may include the capacity to contain and communicate fluid (not shown in FIG. 1). In one or more embodiments, the flow way may include at least one external tubing member 50 (not shown in FIG. 1) and other aspects which may allow fluid to flow from external fluid dispenser 40 and ultimately out of toilet seat's 20 openings 261, 262, 263 and 264 and on to at least one surface of toilet seat 20. Although FIG. 1 shows the use of toilet 12 (which may be used in a commercial setting) other toilets may be used to implement the disclosure. In one or more embodiments, the parts associated with the flow way (such as, for example, but not limited to the external tubing member 50) may be modified to fit different configurations as needed.

Figure 2A:
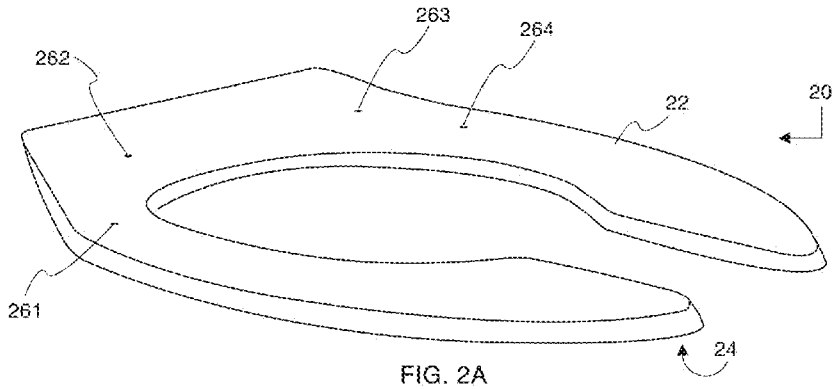
FIG. 2A shows a perspective view of one embodiment of a toilet seat which may include a top surface, a bottom surface (not shown in FIG. 2A), and openings.

FIG. 2A shows a perspective view of one embodiment of toilet seat 20 which may include a top surface 22, a bottom surface 24 (not shown in FIG. 2A), and openings 261, 262, 263 and 264.

Figure 2B:
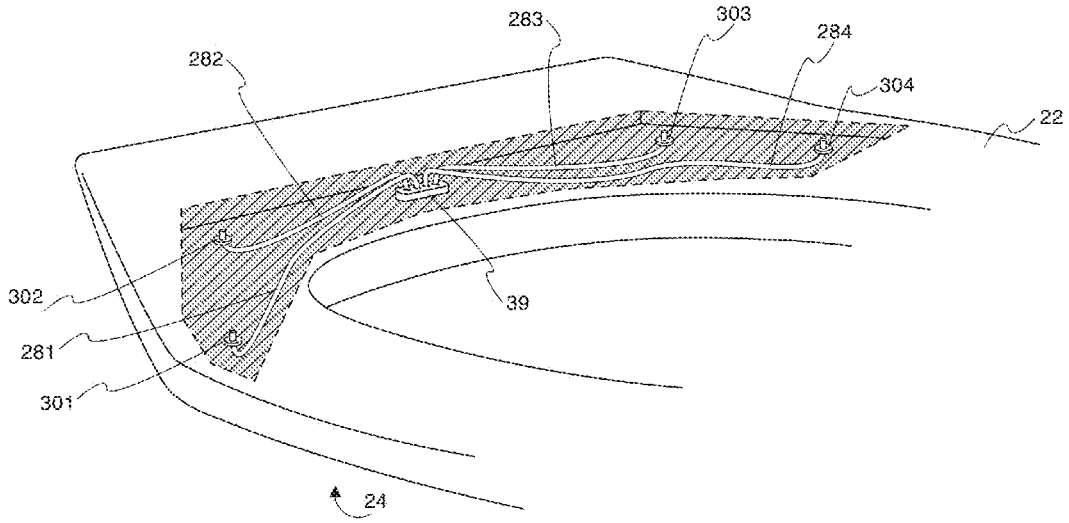
FIG. 2B shows an exploded perspective view of a portion of the embodiment of the toilet seat illustrated in FIG. 2A including a cut away of its top surface and revealing one embodiment of aspects of the flow way.

FIG. 2B shows an exploded perspective view of a portion of the embodiment of toilet seat 20 illustrated in FIG. 2A including a cut away of top surface 22 revealing one embodiment of aspects of the flow way. In one or more embodiments, the flow way may include internal tubing members 281, 282, 283 and 284 (although four internal tubing members are shown in FIG. 2B more or less internal tubing members may be provided); nozzles 301, 302, 303 and 304 (although four nozzles are shown in FIG. 2B more or less nozzles may be provided); and connector member 39 (although one connector member is shown in FIG. 2B more or less connector members may be provided). In one or more embodiments, one or more of the internal tubing members 281, 282, 283 and 284 may be configured to connector member 39. In one or more embodiments, one or more of the internal tubing members 281, 282, 283 and 284 may be configured from the same or different tubing to various dimensions and possessing various characteristics (such as, for example, but not limited to the type of tubing, dimensions and characteristics described herein). In one or more embodiments, each of the internal tubing members 281, 282, 283 and 284 may be configured to at least one nozzle and each nozzle may be configured to at least one of the opening. For example, in one or more embodiments, internal tubing member 281 may be configured to nozzle 301 and nozzle 301 may be configured to opening 261 (not shown on FIG. 2B); internal tubing member 282 may be configured to nozzle 302 and nozzle 302 may be configured to opening 262 (not shown on FIG. 2B); internal tubing member 283 may be configured to nozzle 303 and nozzle 303 may be configured to opening 263 (not shown on FIG. 2B); and internal tubing member 284 may be configured to nozzle 304 and nozzle 304 may be configured to opening 264 (not shown on FIG. 2B).

Figure 2C:
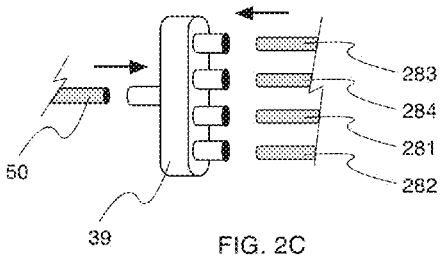
FIG. 2C shows one embodiment of a connector member.

FIG. 2C shows one embodiment of connector member 39 which may include one port that may be configured to external tubing member 50 and four ports that may be configured to the internal tubing members 281, 282, 283 and 284.

Figure 2D:
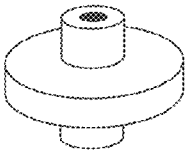
FIG. 2D shows one embodiment of a nozzle.
Figure 2E:
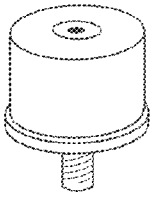
FIG. 2E shows another embodiment of a nozzle.
Figure 2F:
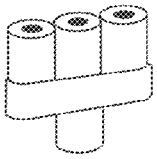
FIG. 2F shows another embodiment of a nozzle.

FIGS. 2D, 2E and 2F show various embodiments of the nozzles which may be included in the flow way. In one or more embodiments, although the illustrations only show three variations of nozzles many other types and sizes of nozzles may be provided.

FIG. 2D shows one embodiment of a nozzle in the form of an in-line dripper.

FIG. 2E shows one embodiment of a nozzle in the form of a micro spray, fogger or mister.

FIG. 2F shows one embodiment of a nozzle in the form of a three holed nozzle.

Figure 2G:
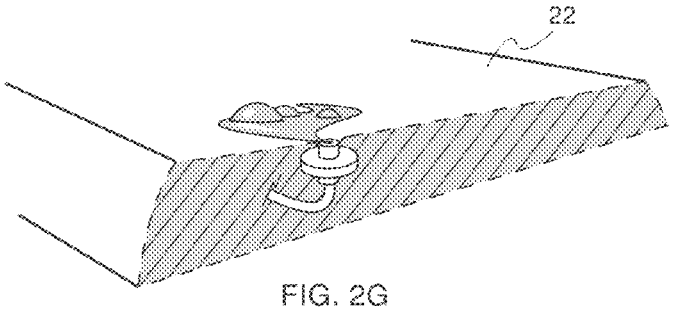
FIG. 2G shows a sectional view of one embodiment of a toilet seat configured with the nozzle illustrated in FIG. 2D.

FIG. 2G shows a sectional view of one embodiment of toilet seat 20 which reveals a portion of one embodiment of an internal tubing member and one embodiment of the nozzle illustrated in FIG. 2D.

Figure 2H:
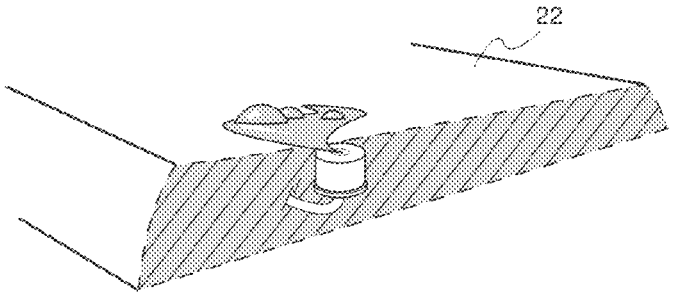
FIG. 2H shows a sectional view of one embodiment of a toilet seat configured with the nozzle illustrated in FIG. 2E.

FIG. 2H shows a sectional view of one embodiment of toilet seat 20 which reveals a portion of one embodiment of an internal tubing member and one embodiment of the nozzle illustrated in FIG. 2E.

Figure 2I:
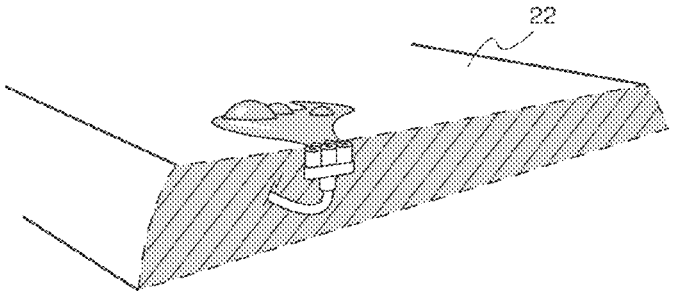
FIG. 2I shows a sectional view of one embodiment of a toilet seat configured with the nozzle illustrated in FIG. 2F.

FIG. 2I shows a sectional view of one embodiment of toilet seat 20 which reveals a portion of one embodiment of an internal tubing member and one embodiment of the nozzle illustrated in FIG. 2F.

Figure 3A:
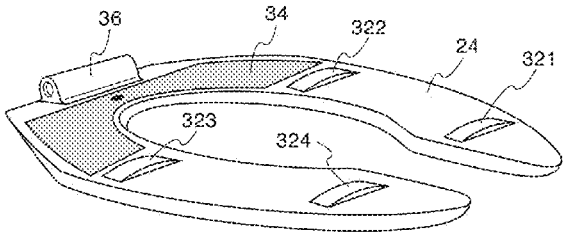
FIG. 3A shows a perspective view of one embodiment of a bottom surface of a toilet seat which may include support members, a compartment door, and a means for articulating the toilet seat.
Figure 3B:
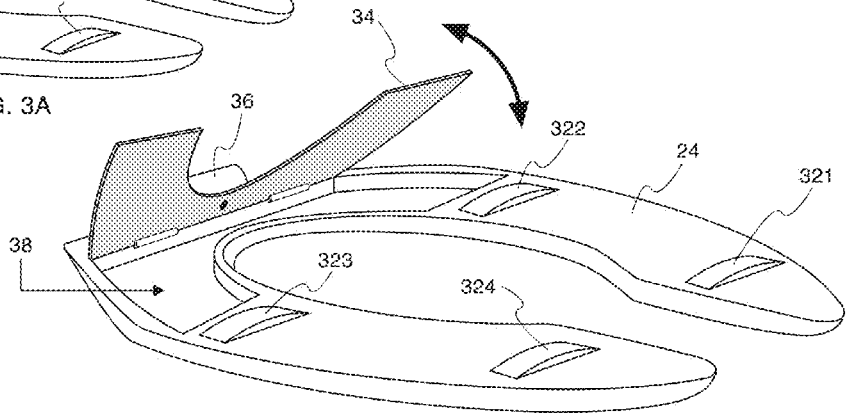
FIG. 3B shows a perspective view of the embodiment of the bottom surface of the toilet seat illustrated in FIG. 3A albeit the compartment door is partially opened revealing a compartment.
Figure 3C:
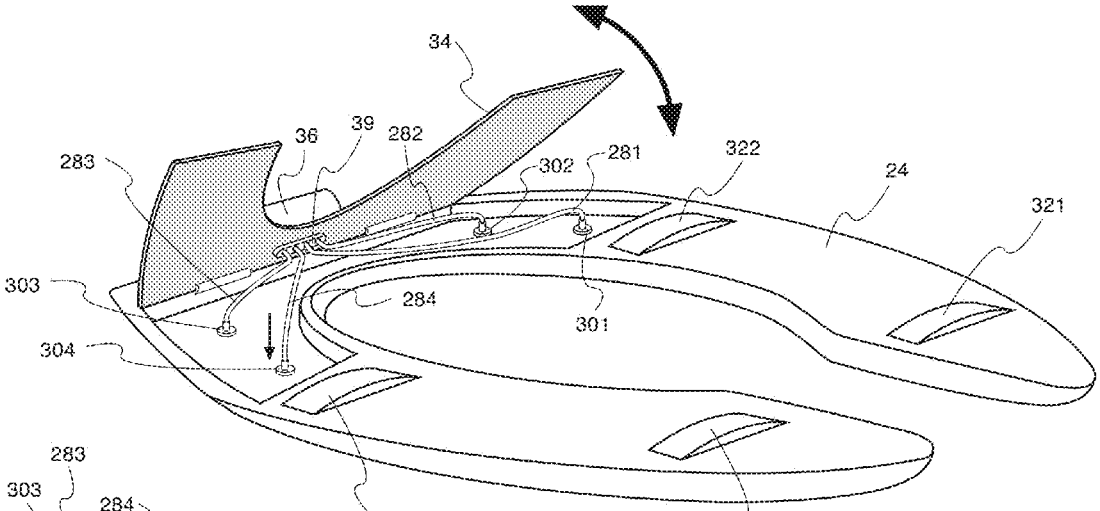
FIG. 3C shows a perspective view of the embodiment of the bottom surface of the toilet seat illustrated in FIG. 3B albeit the compartment is shown housing various flow way components.
Figure 3D:
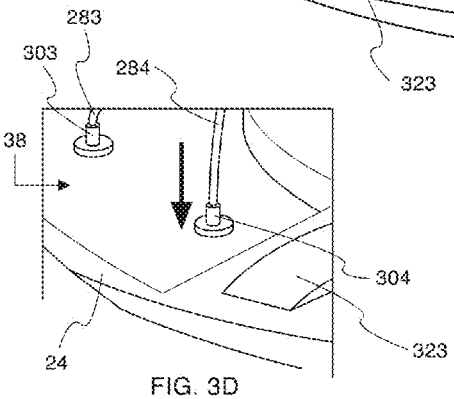
FIG. 3D shows an exploded perspective view of a portion of the embodiment of the bottom surface of the toilet seat illustrated in FIG. 3C.

FIGS. 3A, 3B, 3C, 3D and 3E show various views of embodiments of the bottom surface 24 of toilet seat 20 which may include support members 321, 322, 323 and 324 (although four support members are shown in FIGS. 3A, 3B, 3C and 3E more or less support members of various shapes and comprising various features may be provided), a compartment door 34, a compartment 38 (not shown in FIG. 3A), and a means 36 for articulating toilet seat 20 (not shown in FIG. 3D). In one or more embodiments, the dimensions of compartment door 34 may be configured to allow a user sufficient space to access aspects of toilet seat 20 and the flow way. In one or more embodiments, compartment door 34 may be configured to be repeatedly opened and closed, wherein said closure may be accomplished by various means (such as, for example, but not limited to snapping, fastening, clamping, hooking, attaching, securing, connecting, pinching, cleaving, clinging, clasping, latching, welding, bolting, screwing, sticking, fitting, sliding, and the like and other materials, adhesives, devices, systems, means, and methods, and/or combinations thereof; and in one or more embodiments, said means may be configured to be releasable and/or non-releasable). In one or more embodiments, compartment door 34 may be configured in a closed position such that compartment door 34 is substantially flush with or depressed into bottom surface 24. In one or more embodiments, the depth, width, length and other dimensions and/or configurations of compartment 38 may vary depending on the size of the toilet seat, the size and number of flow way parts, and/or other considerations. In one or more embodiments, although FIGS. 3A, 3B, 3C and 3D (and elsewhere) show the means 36 for articulating toilet seat 20 comprising a cylindrical shaped configuration, any configuration designed to allow toilet seat 20 to articular may suffice (such as, for example, but not limited to a hinge or other means).

FIG. 3A shows a perspective view of one embodiment of bottom surface 24 of toilet seat 20 which may include support members 321, 322, 323 and 324, compartment door 34, and means 36 for articulating toilet seat 20. The embodiment of compartment door 34 as illustrated in FIG. 3A is in a closed position. In one or more embodiments, a hole or opening may be configured to compartment door 34 wherein aspects of the flow way (such as, for example, but not limited to connector member 39, see FIG. 3C below) may be configured.

FIG. 3B shows a perspective view of the embodiment of the bottom surface 24 of toilet seat 20 illustrated in FIG. 3A which may include compartment 38. FIG. 3B shows compartment door 34 in partially-open position revealing compartment 38 (which in FIG. 3B lacks any flow way components).

FIG. 3C shows a perspective view of the embodiment of the bottom surface 24 of toilet seat 20 illustrated in FIG. 3B including compartment door 34 in partially-open position revealing compartment 38 housing various flow way components. In one or more embodiments, compartment 38 may include various flow way components, such as, for example, but not limited to connector member 39, internal tubing members 281, 282, 283 and 284, and nozzles 301, 302, 303 and 304. In one or more embodiments, internal tubing member 281 may be configured to nozzle 301 which may be configured to opening 261 (opening 261 is not shown in FIG. 3C); internal tubing member 282 may be configured to nozzle 302 which may be configured to opening 262 (opening 262 is not shown in FIG. 3C); internal tubing member 283 may be configured to nozzle 303 which may be configured to opening 263 (opening 263 is not shown in FIG. 3C); and internal tubing member 284 may be configured to nozzle 304 which may be configured to opening 264 (opening 264 is not shown in FIG. 3C). In one or more embodiments, connector member 39 (and/or other aspects of the flow way) may be configured to a hole or opening in compartment door 34. In one or more embodiments, at least one port of connector member 39 may be configured to one of the internal tubing members 281, 282, 283 and 284 and at least one port of connector member 39 may be configured to the external tubing member 50 (not shown in FIG. 3C).

FIG. 3D shows an exploded perspective view of a portion of the embodiment of the bottom surface 24 of toilet seat 20 as illustrated in FIG. 3C wherein internal tubing member 283 may be configured to nozzle 303 which may be configured to opening 263 (opening 263 is not shown in FIG. 3D) and wherein internal tubing member 284 may be configured to nozzle 304 which is configured to opening 264 (opening 264 is not shown in FIG. 3D).

Figure 3E:
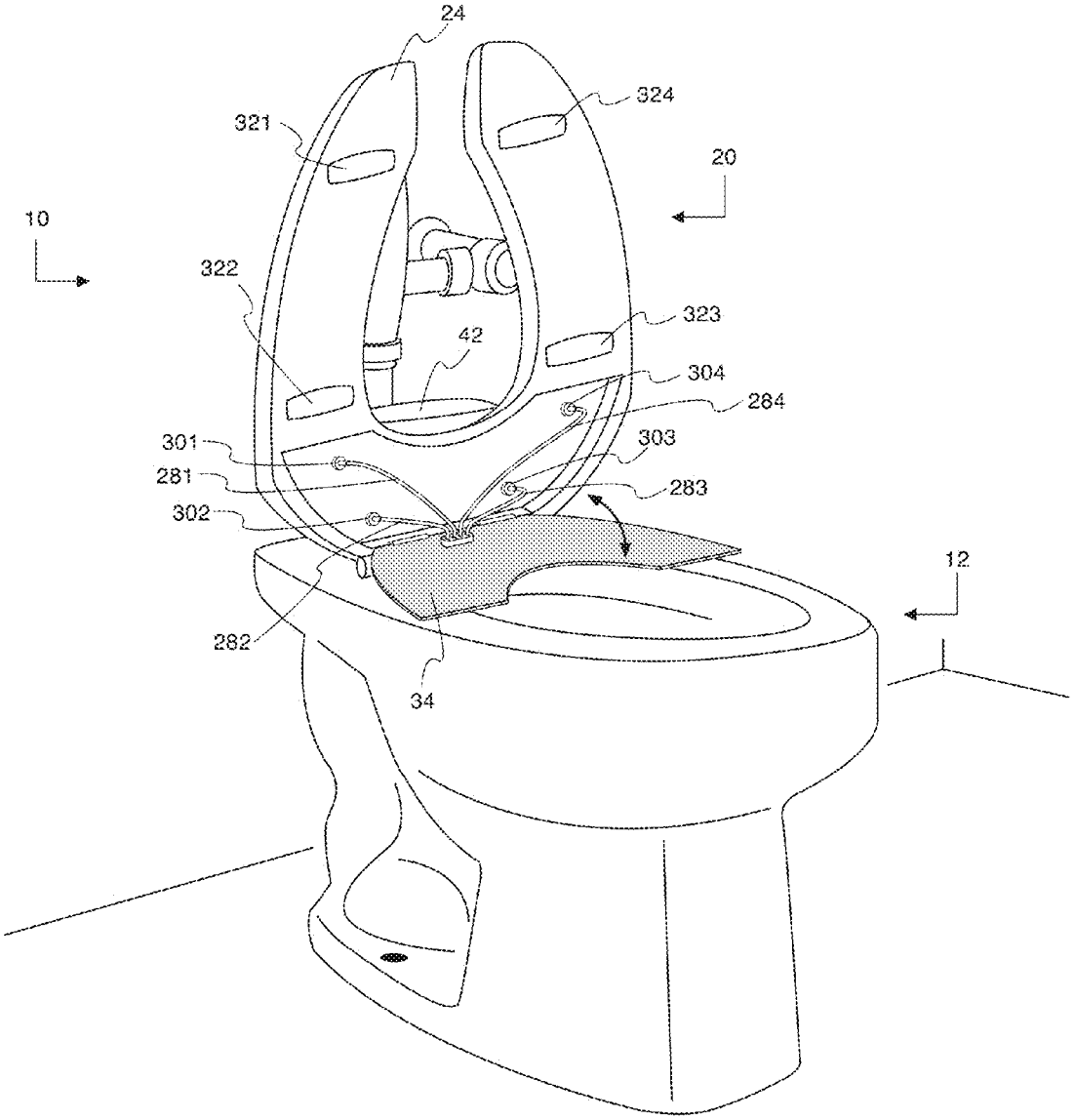
FIG. 3E shows one embodiment of a bottom surface of a toilet seat in upright position wherein its compartment door is opened and exposing various flow way components.

FIG. 3E shows one embodiment of bottom surface 24 of toilet seat 20 in upright position wherein the compartment door 34 is opened and exposing various flow way components.

FIGS. 4A, 4B, 4C, 4D, 4E, 4F and 4G show aspects of various embodiments of an external fluid dispenser 40.

Figure 4A:
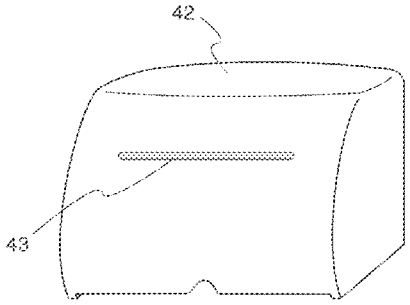
FIG. 4A shows one embodiment of aspects of an external fluid dispenser which may include a cover and a fluid indicator.

FIG. 4A shows one embodiment of aspects of external fluid dispenser 40 which may include a cover 42 and a fluid indicator 43. In one or more embodiments, aspects of external fluid dispenser 40 may be configured to various dimensions. In one or more embodiments, external fluid dispenser 40 may be configured to about 8 inches wide, about 4 inches deep and about 3 and ½ inches long. In one or more embodiments, fluid indicator 43 may indicate to users the amount of fluid remaining in the fluid dispenser and/or simply be a clear or colored window.

Figure 4B:
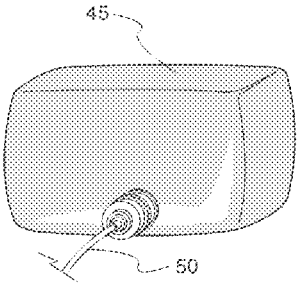
FIG. 4B shows one embodiment of aspects of an external fluid dispenser which may include a fluid container.

FIG. 4B shows one embodiment of aspects of external fluid dispenser 40 which may include a fluid container 45. FIG. 4B also shows aspects of a flow way (i.e. external tubing member 50) configured to fluid container 45. In one or more embodiments, fluid container 45 may include various configurations. For example, in one or more embodiments, fluid container 45 may include a cartridge which may be capable of containing various amounts of fluid (such as, for example, but not limited to over about 1000 mL of fluid and/or between about 900 mL to about 3,000 mL of fluid) and communicating said fluid. In one or more embodiments, each fluid container 45 may be configured to provide over about 1000 wipes and/or between about 1,000 to about 4,000 wipes before refilling and/or replacement is necessary. In one or more embodiments, fluid container 45 may be refillable, reusable and/or replaceable.

Figure 4D:
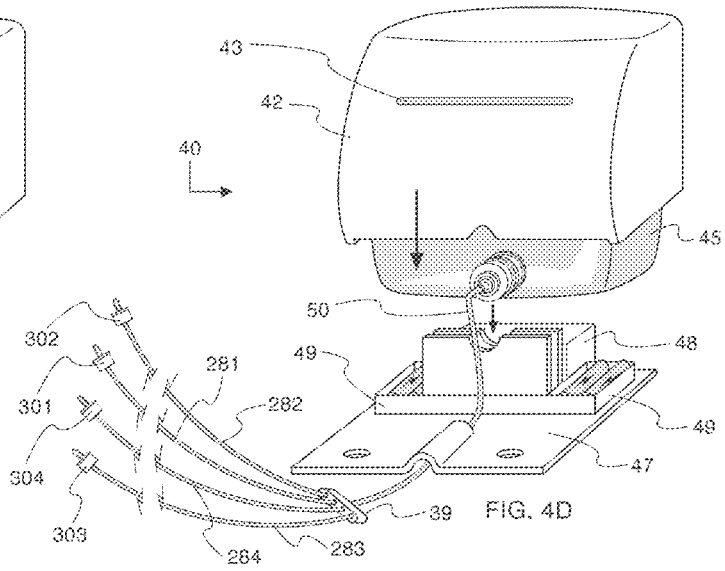
FIG. 4D shows one embodiment of the aspects of the external fluid dispenser illustrated in FIGS. 4A, 4B and 4C.
Figure 4C:
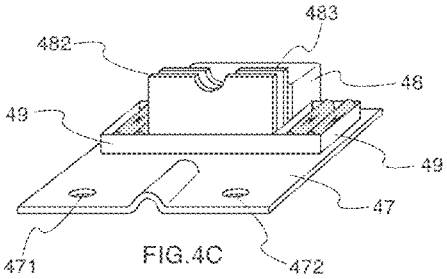
FIG. 4C shows one embodiment of aspects of an external fluid dispenser which may include a base plate, a dispenser mechanism, and a power source.

FIG. 4C shows one embodiment of aspects of external fluid dispenser 40 which may include a base plate 47, a dispenser mechanism 48, a power source 49 and a sensor 60 (not shown in FIG. 4C). In one or more embodiments, base plate 47 may include holes (such as, for example, but not limited to holes 471 and 472) or other means for configuring it to a toilet. Although not shown in FIG. 4C, in one or more embodiments, base plate 47 may be configured with screws or other means for configuring base plate to a toilet (such as, for example, but not limited to screws configured under power source 49 as illustrated in FIG. 5C). In one or more embodiments, dispenser mechanism 48 may be configured to base plate 47, power source 49 and/or sensor 60 (not shown in FIG. 4C). In one or more embodiments, power source 49 may be configured to base plate 47. In one or more embodiments, sensor 60 which, when activated, may initiate electronical signals or other communications which trigger dispenser mechanism 48 which may influence fluid being communicated out of the fluid container 45 and ultimately out of at least one openings 261, 262, 263 and 264 and onto at least one surface of a toilet seat (such as, for example, but not limited to toilet seat 20). In one or more embodiments, dispenser mechanism 48 may include arms 483 and 482. In one or more embodiments, arms 483 and 482 may assist in influencing fluid being communicated out of the fluid container 45 as further describe below (see FIGS. 4F and 4G). In one or more embodiments, power source 49 may include batteries or other sources of power.

FIG. 4D shows one embodiment of aspects of external fluid dispenser 40 illustrated in FIGS. 4A, 4B and 4C being configured together such that cover 42 is positioned partially over fluid container 45 and fluid container 45 is approaching base plate 47, dispenser mechanism 48, and power source 49. FIG. 4D also shows one embodiment of aspects of the flow way which may include external tubing member 50, connector member 39 and internal tubing members 281, 282, 283 and 284. In one or more embodiments, external tubing member 50 may be configured to dispenser mechanism 48. In one or more embodiments, external tubing member 50 may be configured to connector member 39. In one or more embodiments, connector member 39 may be configured to internal tubing member 281, 282, 283 and 284, each of which may be configured to one of the nozzles 301, 302, 303 and 304. In one or more embodiments, although not shown in FIG. 4D, each of the nozzles 301, 302, 303 and 304 may be configured to one of the openings 261, 262, 263 and 264. In one or more embodiments, when fluid container 45 is configured to external tubing member 50 and when dispenser mechanism 48 is activated, fluid may flow from fluid container 45, through external tubing member 50 and ultimately out openings 261, 262, 263 and 264 and onto at least one surface on toilet seat 20.

Figure 4E:
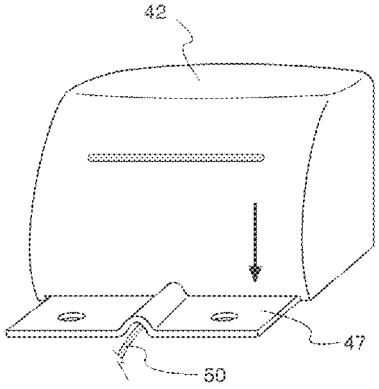
FIG. 4E shows one embodiment of the cover of external fluid dispenser illustrated in FIG. 4A being configured over aspects of the external fluid dispenser.

FIG. 4E shows one embodiment of the cover 42 of external fluid dispenser 40 configured over aspects of external fluid dispenser's 40 internal components and residing on base plate 47. In one or more embodiments, base plate 47 may include a channel or hump through which or under which external tubing member 50 may be configured so that external tubing member 50 may not be visible to users when cover 42 may overlay aspects of external fluid dispenser 40 as shown in FIG. 4E.

Figure 4F:
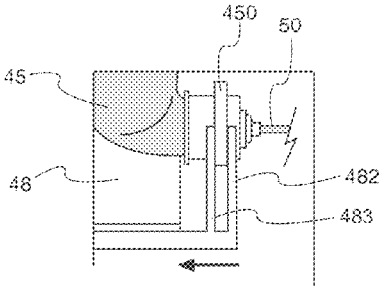
FIG. 4F shows one embodiment of aspects of a process for influencing the communication of fluid out of the fluid container.

FIG. 4F shows One embodiment of aspects of a process for influencing the communication of fluid out of the fluid container 45. FIG. 4F shows one embodiment of aspects of dispenser mechanism 48 (including but not limited to arm 483 and arm 482) and aspects of fluid container 45. In one or more embodiment, fluid container 45 may be configured with a pump mechanism 450. In one or more embodiment, sensor 60 which, when activated, may initiate electronical signals or other communications which trigger dispenser mechanism 48 to move arm 483 and arm 482 in a direction which may manipulate pump mechanism 450 which may influence the communication of fluid out of fluid container 45.

Figure 4G:
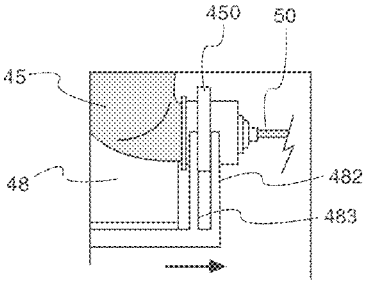
FIG. 4G shows one embodiment of other aspects of a process for influencing the communication of fluid out of the fluid container.

FIG. 4G shows one embodiment of other aspects of a process for influencing the communication of fluid out of the fluid container 45. FIG. 4G is similar to FIG. 4F except that it shows one embodiment of pump mechanism 450 manipulated and in different direction and/or position to be released.

Although not shown in FIG. 4C, 4D 4F, 4G, 5A, 5B or 5C, in one or more embodiments, fluid container 45 may be configured to dispenser mechanism 48 and/or cover 42 in such a way so as to enable the manipulation of pump mechanism 450 to effectively influence the communication of fluid out of fluid container 45. For example, in one or more embodiments, dispenser mechanism 48 may be configured with straps or other means which secure fluid container 45 to dispenser mechanism 48 and minimize or prevent fluid container 45 from moving while pump mechanism 450 is being manipulated. In one or more embodiments, the contour of at least one surface of dispenser mechanism 48 may be configured to grip to, secure, adhere to, or otherwise configured fluid container 45 to dispenser mechanism 48 and minimize or prevent fluid container 45 from moving while pump mechanism 450 is being manipulated. In one or more embodiments, the structure of cover 42 may be configured to minimize or prevent fluid container 45 from moving while pump mechanism 450 is being manipulated, such as, for example, but not limited to adding a wedge between fluid container and the inside front wall and/or back wall of cover 42.

Figure 5A:
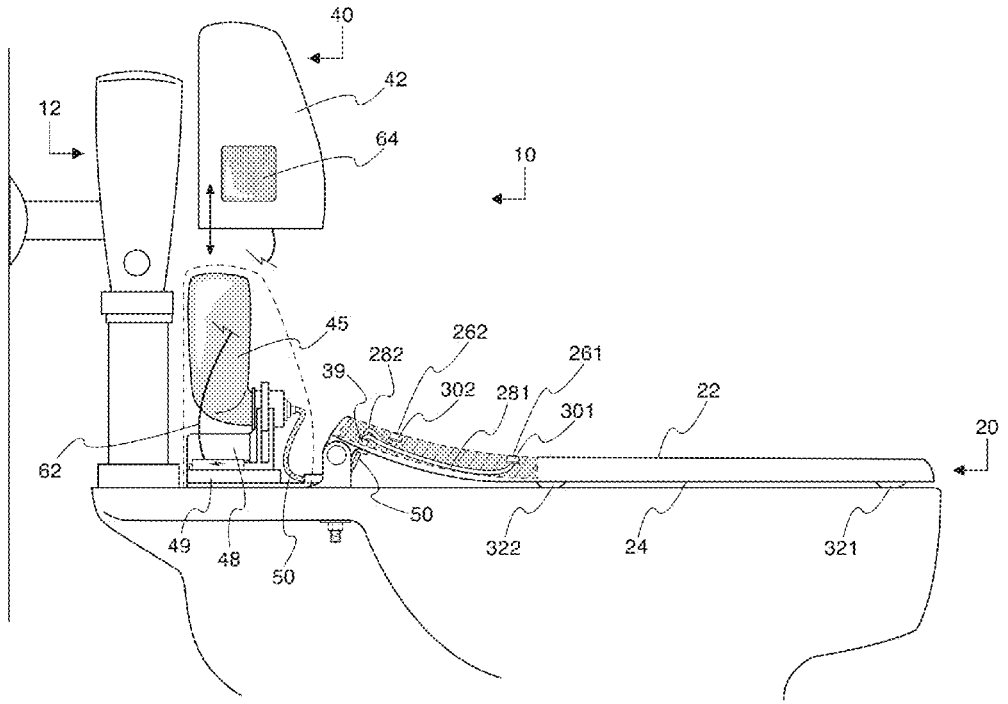
FIG. 5A shows a side view of one embodiment of aspects of a toilet seat cleaning system including aspects of a toilet, a toilet seat, a flow way and an external fluid dispenser.

FIG. 5A shows a side view of one embodiment of aspects of toilet seat cleaning system 10 including aspects of toilet 12, toilet seat 20, the flow way and external fluid dispenser 40 wherein the cover 42 of external fluid dispenser 40 has been removed and is positioned above other aspects of external fluid dispenser 40. FIG. 5A shows a cut away of a portion of toilet seat 20 which reveals one embodiment of aspects of the flow way including internal tubing members 281, 282, 283 (not shown in FIG. 5A) and 284 (not shown in FIG. 5A), nozzle 301, 302, 303 (not shown in FIG. 5A) and 304 (not shown in FIG. 5A), connector member 39 and external tubing member 50. The cut away also shows one embodiment of openings 261, 262, 263 (not shown in FIG. 5A) and 264 (not shown in FIG. 5A). In one or more embodiments, various toilets other than toilet 12 may be used.

Figure 5B:
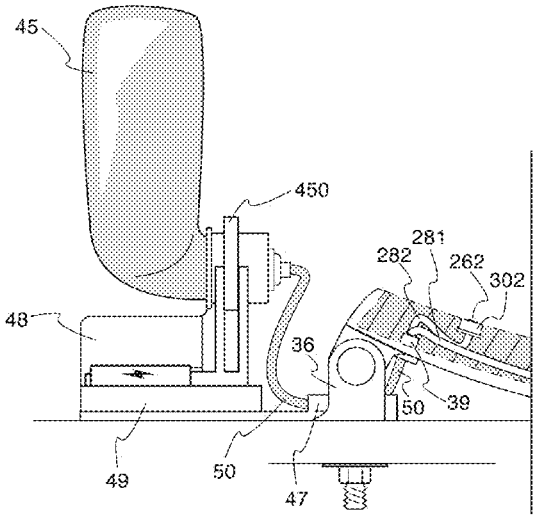
FIG. 5B shows an exploded side view of one embodiment of aspects of the disclosure illustrated in FIG. 5A.
Figure 5C:
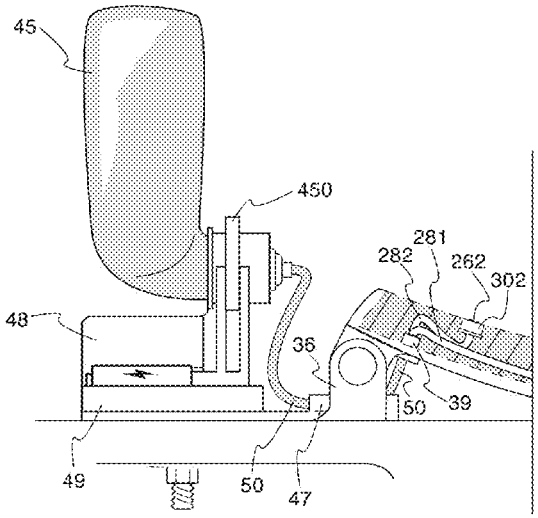
FIG. 5C shows an exploded side view of one embodiment of aspects of the disclosure illustrated in FIG. 5A albeit at least one screw is located in a different place as compared to that which is illustrated in FIG. 5A.

FIG. 5B shows an exploded side view of one embodiment of aspects of the disclosure illustrated in FIG. 5A. FIG. 5B shows one embodiment wherein screws may configure means 36 for articulating toilet seat 20 to toilet 12 via the holes 471 and 472 provided by base plate 47.

FIG. 5C shows an exploded side view of one embodiment of aspects of the disclosure illustrated in FIG. 5A. FIG. 5C shows one embodiment wherein screws may configure base plate 47 to toilet 12 via screws or other means residing inferior to power source 49. In such an instance, in one or more embodiments, toilet 20 may be configured to base plate 47 by various means. Such an arrangement, in one or more embodiment, may cause toilet seat 20 to be positioned forward.

Figure 6A:
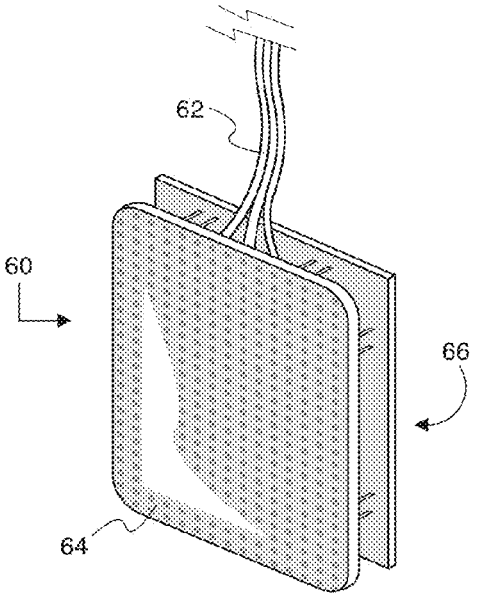
FIG. 6A shows a front perspective view of one embodiment of a sensor which may include a front side, a back side and a means for communicating with other aspects of a toilet seat cleaning system.
Figure 6B:
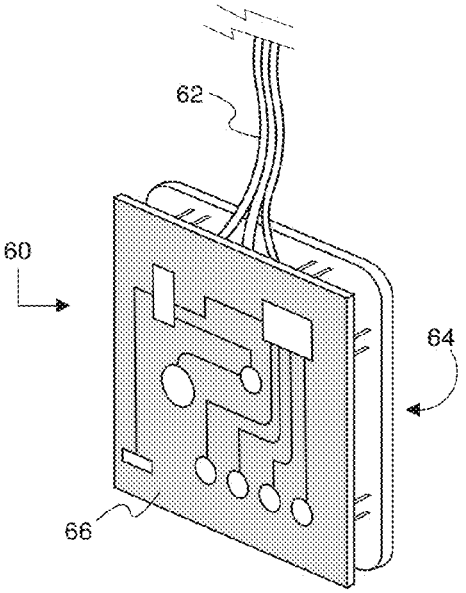
FIG. 6B shows a back perspective view of the embodiment of the sensor illustrated in FIG. 6A.
Figure 6C:
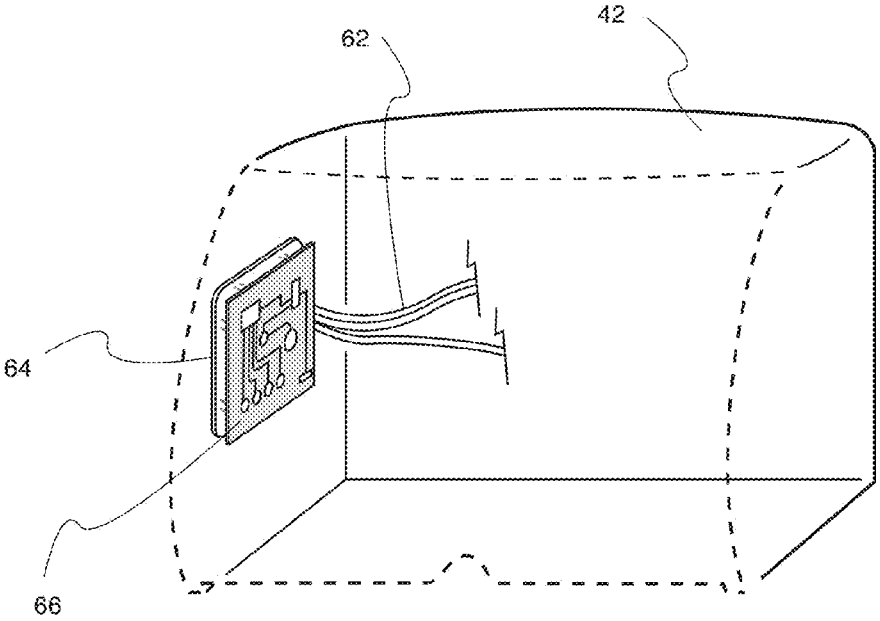
FIG. 6C show one embodiment of a sensor configured to a cover of an external fluid dispenser.

FIGS. 6A, 6B and 6C show various embodiments of aspects of sensor 60.

FIG. 6A shows a front perspective view of one embodiment of sensor 60 which may include a front side 64, a back side 66 and a means 62 (such as, for example, but not limited to for wires) for communicating with other aspects of toilet seat cleaning system 10, such as, for example, but not limited to dispenser mechanism 48 and/or power source 49 (neither of which are shown in FIG. 6A). In one or more embodiments, front side 64 may include at least a portion of the user and/or object detection functionality of sensor 60.

FIG. 6B shows a back perspective view of the embodiment of sensor 60 illustrated in FIG. 6A. In one or more embodiments, back side 66 may include at least a portion of the circuitry and/or hardware components of sensor 60 and may be configured with means 62 for communicating with other aspects of toilet seat cleaning system 10.

FIG. 6C shows one embodiment of sensor 60 configured to the cover 42 of external fluid dispenser 40. Although sensor 60 is shown in FIG. 6C to be configured to cover 42, in one or more embodiments, sensor may be configured to different surfaces of cover 42 and/or on a wall or some other surface. In one or more embodiments, sensor 60 may be configured to external fluid dispenser wirelessly. Although sensor 60 is shown in FIG. 6C to be square in shape, in one or more embodiments, sensor 60 could be circular in form and smaller.

FIGS. 7A, 7B and 7C show various embodiments of toilet seat cleaning system 10 which may include various toilets, toilet seat 20, external fluid dispenser 40, and a flow way. In one or more embodiments, toilet seat 20 may include openings 261, 262, 263 and 264 (although four openings are shown in FIGS. 7A, 7B and 7C more or less openings may be provided). In one or more embodiments, external fluid dispenser 40 may include the capacity to contain and communicate fluid (not shown in FIGS. 7A, 7B and 7C). In one or more embodiments, the flow way may include at least one external tubing member 50 and other aspects which may allow fluid to flow from external fluid dispenser 40 and ultimately out of toilet seat's 20 openings 261, 262, 263 and 264 and on to at least one surface of toilet seat 20.

FIG. 7A shows one embodiment of toilet seat cleaning system 10 which may include a toilet 11, toilet seat 20, external fluid dispenser 40, and a flow way. In one or more embodiments, toilet 11 may be used in a residential setting and include a conventional tank, toilet bowel and other parts associated with such a system. Although external fluid dispenser 40 is shown in FIG. 7A to be configured to one side of the tank of toilet 11, in one or more embodiments, external fluid dispenser 40 may be configured to any available surface of toilet 11 and/or on any wall or other surface. In one or more embodiments, the parts associated with the flow way (such as, for example, but not limited to the external tubing member 50) may be modified to fit such different configurations as needed. Although FIG. 7A does not show toilet seat 20 including a lid, in one or more embodiments toilet seat 20 may be configured with a lid.

FIG. 7B shows one embodiment of toilet seat cleaning system 10 which may include a toilet 12, toilet seat 20, external fluid dispenser 40, and a flow way. In one or more embodiments, toilet 12 may be used in a commercial setting and include tankless functionality, a toilet bowel and other parts associated with such a system. Although external fluid dispenser 40 is shown in FIG. 7B to be configured on the wall behind toilet 12, in one or more embodiments, external fluid dispenser 40 may be configured on toilet 12 and/or to any available wall or other surface. In one or more embodiments, the parts associated with the flow way (such as, for example, but not limited to the external tubing member 50) may be modified to fit different configurations as needed.

FIG. 7C shows one embodiment of toilet seat cleaning system 10 which may include a toilet 13, toilet seat 20, external fluid dispenser 40, and a flow way. In one or more embodiments, toilet 13 may be a portable toilet (such as, for example, but not limited to a Porta-Potty, etc.) that may include certain parts associated with such a system. Although external fluid dispenser 40 is shown in FIG. 7C to be configured on the rear wall of the portable toilet, in one or more embodiments, external fluid dispenser 40 may be configured to any available wall or other surface. In one or more embodiments, the parts associated with the flow way (such as, for example, but not limited to the external tubing member 50) may be modified to fit such different configurations as needed.

Figure 8A:
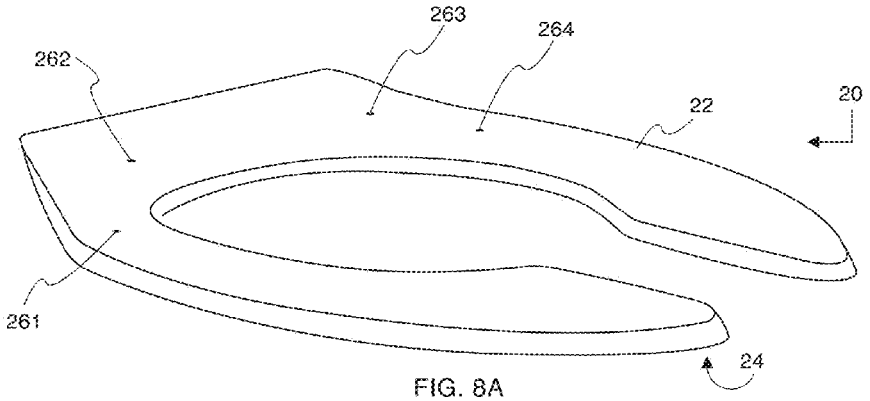
FIG. 8A shows a perspective view of one embodiment of a toilet seat which may include a top surface, a bottom surface (not shown in FIG. 8A), and openings.

FIG. 8A shows a perspective view of one embodiment of toilet seat 20 which may include top surface 22, bottom surface 24 (not shown in FIG. 2A), and openings 261, 262, 263 and 264.

Figure 8B:
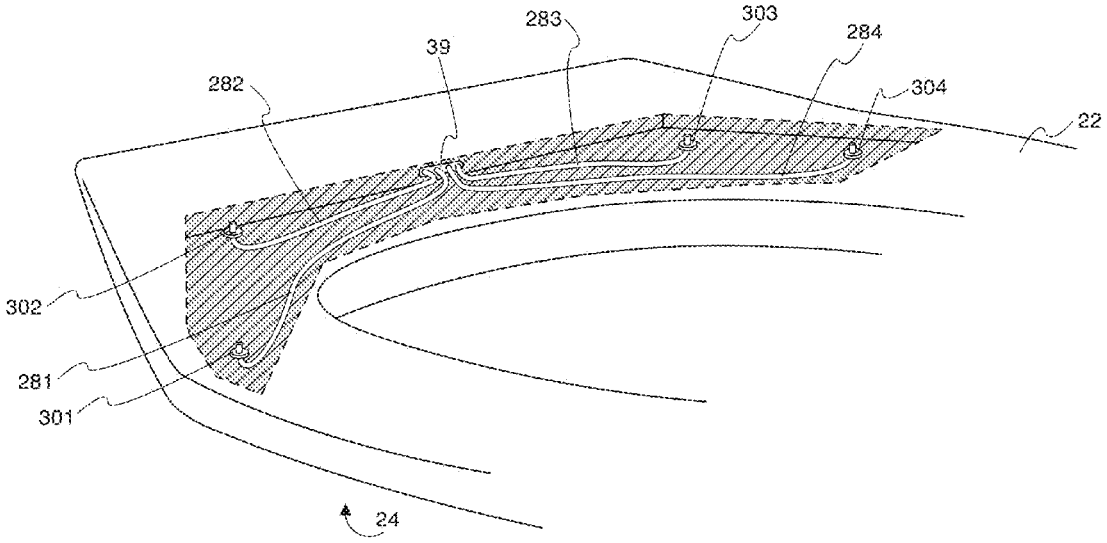
FIG. 8B shows an exploded perspective view of a portion of the embodiment of the toilet seat illustrated in FIG. 8A including a cut away of its top surface and revealing one embodiment of aspects of the flow way.

FIG. 8B shows an exploded perspective view of a portion of the embodiment of toilet seat 20 illustrated in FIG. 8A including a cut away of top surface 22 revealing one embodiment of aspects of the flow way. In one or more embodiments, aspects of the configuration of the flow way illustrated in FIG. 8B may be similar to aspects of the configuration of the flow way illustrated in FIG. 2B. For example, in one or more embodiments, the flow way may include internal tubing members 281, 282, 283 and 284 (although four internal tubing members are shown in FIG. 8B more or less internal tubing members may be provided); nozzles 301, 302, 303 and 304 (although four nozzles are shown in FIG. 8B more or less nozzles may be provided); and connector member 39 (although one connector member is shown in FIG. 8B more or less connector members may be provided), which may be similarly configured. In one or more embodiments, each of the internal tubing members 281, 282, 283 and 284 may be configured to various dimensions. In one or more embodiments, aspects of the configuration of the flow way illustrated in FIG. 8B may be different than aspects of the configuration of the flow way illustrated in FIG. 2B. For example, the embodiment of the flow way illustrated in FIG. 8B shows connector member 39 being configured in a different location on toilet seat 20 (such as, for example, but not limited to a surface on compartment 38, see FIG. 9C below) as compared to the configuration of connector member 39 illustrated in FIG. 2B (the hole or opening in compartment door 34).

Figure 9A:
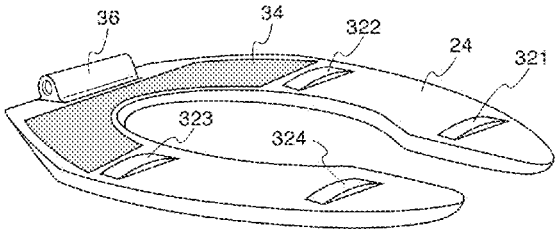
FIG. 9A shows a perspective view of one embodiment of a bottom surface of a toilet seat which may include support members, a compartment door, and a means for articulating the toilet seat.
Figure 9B:
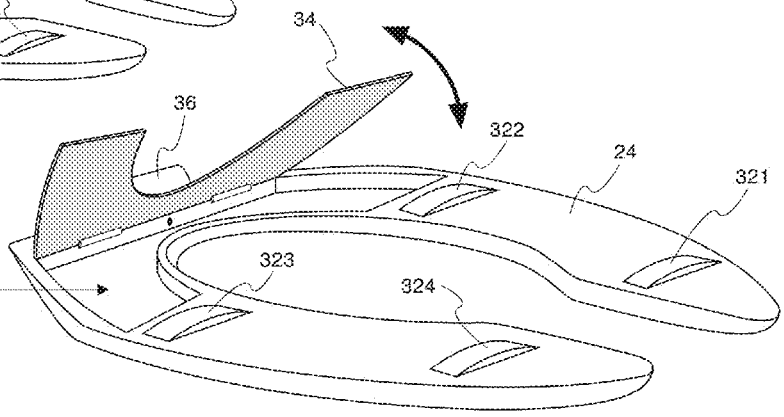
FIG. 9B shows a perspective view of the embodiment of the bottom surface of the toilet seat illustrated in FIG. 9A albeit the compartment door is partially opened revealing a compartment.
Figure 9C:
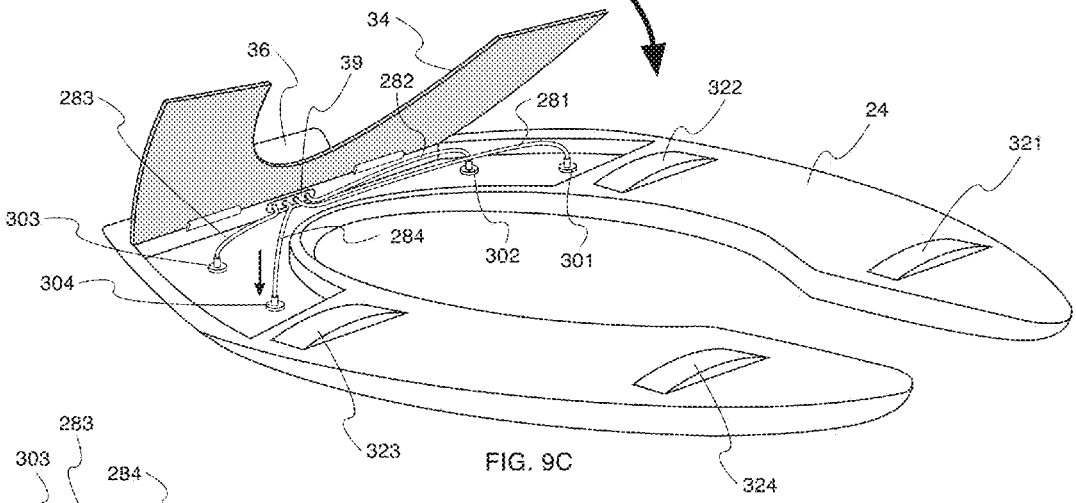
FIG. 9C shows a perspective view of one embodiment of the bottom surface of toilet seat illustrated in FIG. 9B albeit the compartment is shown housing various flow way components.
Figure 9D:
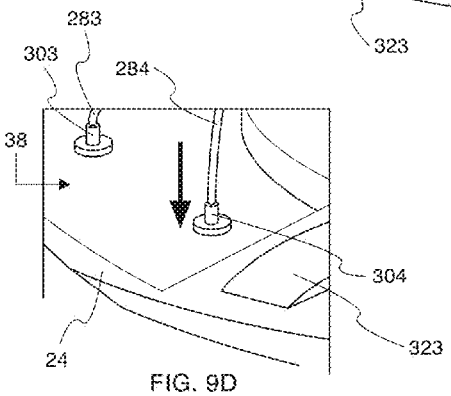
FIG. 9D shows an exploded perspective view of a portion of the embodiment of the bottom surface of the toilet seat illustrated in FIG. 9C.
Figure 9E:
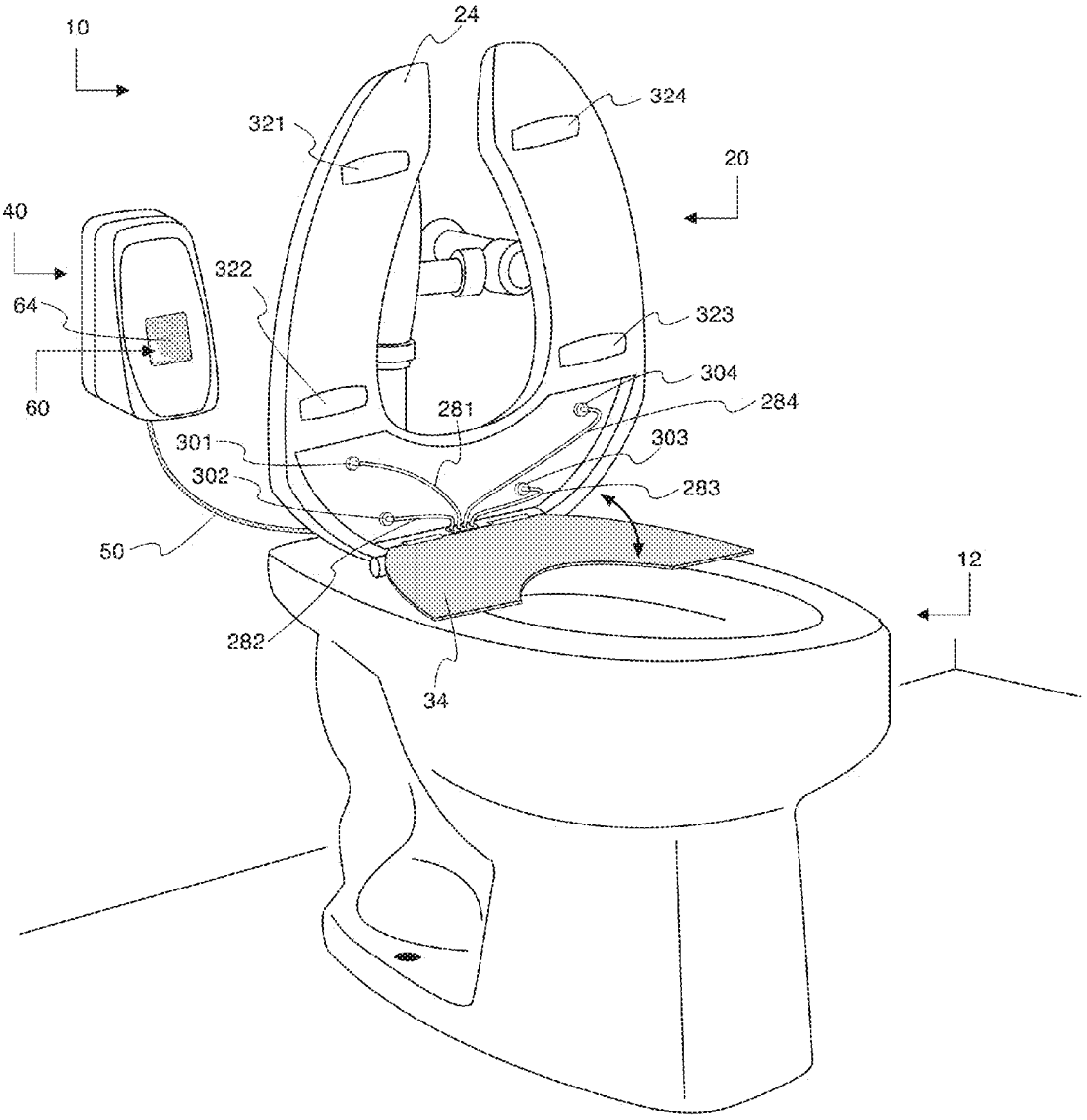
FIG. 9E shows one embodiment of a bottom surface of a toilet seat in upright position wherein its compartment door is opened and exposing various flow way components.

FIGS. 9A, 9B, 9C, 9D and 9E show various views of embodiments of the bottom surface 24 of toilet seat 20. In one or more embodiments, aspects of the configuration of the toilet seat 20 illustrated in FIGS. 9A, 9B, 9C, 9D and 9E may be similar to aspects of the configuration of toilet seat 20 illustrated in FIGS. 3A, 3B, 3C, 3D and 3E. For example, in one or more embodiments, the bottom surface 24 of toilet seat 20 may include support members 321, 322, 323 and 324 (although four support members are shown in FIGS. 9A, 9B, 9C and 9E more or less support members of various shapes and comprising various features may be provided), compartment door 34, compartment 38 (not shown in FIG. 9A), and means 36 for articulating toilet seat 20 (not shown in FIG. 9D), which may be similarly configured. In one or more embodiments, aspects of the configuration of the toilet seat 20 illustrated in FIGS. 9A, 9B, 9C, 9D and 9E may be different than aspects of the configuration of toilet seat 20 illustrated in FIGS. 3A, 3B, 3C, 3D and 3E. For example, in one or more embodiments, as illustrated in FIGS. 9B, 9C and 9E, a hole or opening may be configured on a surface of compartment 38 wherein aspects of the flow way (such as, for example, but not limited to connector member 39) may be configured.

FIG. 9A shows a perspective view of one embodiment of the bottom surface 24 of toilet seat 20 which may include support members 321, 322, 323 and 324, compartment door 34, and means 36 for articulating toilet seat 20. The embodiment of compartment door 34 as illustrated in FIG. 9A is in a closed position.

FIG. 9B shows a perspective view of one embodiment of the bottom surface 24 of toilet seat 20 which may include compartment 38. FIG. 9B shows compartment door 34 in partially-open position revealing compartment 38 (which in FIG. 9B lacks any flow way components). In one or more embodiments, a hole or opening may be configured on a surface of compartment 38 wherein aspects of the flow way (such as, for example, but not limited to connector member 39) may be configured.

FIG. 9C shows a perspective view of one embodiment of the bottom surface 24 of toilet seat 20 including compartment door 34 in partially-open position revealing compartment 38 housing various flow way components. In one or more embodiments, compartment 38 may include various flow way components, such as, for example, but not limited to connector member 39, internal tubing members 281, 282, 283 and 284, and nozzles 301, 302, 303 and 304. In one or more embodiments, internal tubing member 281 may be configured to nozzle 301 which may be configured to opening 261 (opening 261 is not shown in FIG. 9C); internal tubing member 282 may be configured to nozzle 302 which may be configured to opening 262 (opening 262 is not shown in FIG. 9C); internal tubing member 283 may be configured to nozzle 303 which may be configured to opening 263 (opening 263 is not shown in FIG. 9C); and internal tubing member 284 may be configured to nozzle 304 which may be configured to opening 264 (opening 264 is not shown in FIG. 9C). In one or more embodiments, a hole or opening may be configured on a surface of compartment 38 wherein aspects of the flow way (such as, for example, but not limited to connector member 39) may be configured. In one or more embodiments, at least one port of connector member 39 may be configured to one of the internal tubing members 281, 282, 283 and 284 and at least another port of connector member 39 may be configured to the at least one external tubing member 50 (not shown in FIG. 9C).

FIG. 9D shows an exploded perspective view of a portion of the embodiment of the bottom surface 24 of toilet seat 20 as illustrated in FIG. 9C wherein internal tubing member 283 may be configured to nozzle 303 which may be configured to opening 263 (opening 263 is not shown in FIG. 9D) and wherein internal tubing member 284 may be configured to nozzle 304 which is configured to opening 264 (opening 264 is not shown in FIG. 9D).

FIG. 9E shows one embodiment of bottom surface 24 of toilet seat 20 in upright position wherein the compartment door 34 is opened and exposing various flow way components. Although FIG. 9E shows the use of toilet 12 (which may be used in a commercial setting) other toilets may be used to implement the disclosure.

FIGS. 10A, 10B, 10C, 10D, 10E and 10F show embodiments of various aspects of external fluid dispenser 40.

Figure 10A:
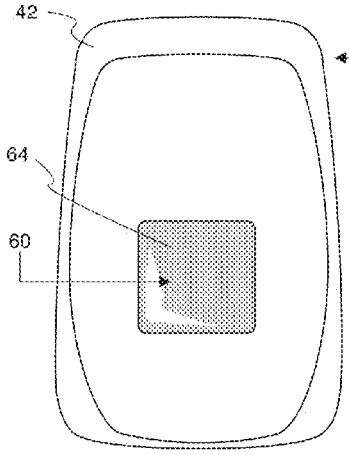
FIG. 10A shows a front view of one embodiment of an external fluid dispenser which may include a cover and a sensor.

FIG. 10A shows a front view of one embodiment of external fluid dispenser 40 which may include cover 42 and sensor 60. In one or more embodiments, aspects of external fluid dispenser 40 may be configured to various dimensions. For example, in one or more embodiments, cover 42 may be configured to about 5 inches wide, about 4 inches deep and about 12 inches long.

Figure 10B:
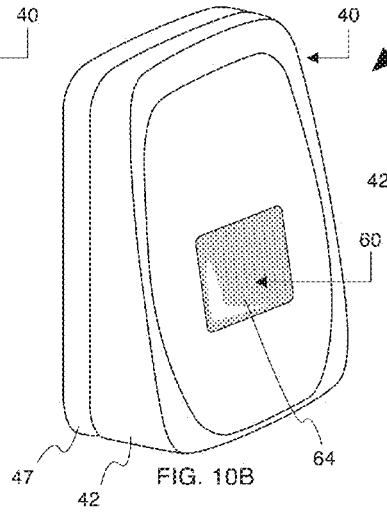
FIG. 10B shows a perspective view of one embodiment of an external fluid dispenser which may include a cover, a base plate, and a sensor.

FIG. 10B shows a perspective view of one embodiment of external fluid dispenser 40 which may include cover 42, base plate 47, and sensor 60.

Figure 10C:
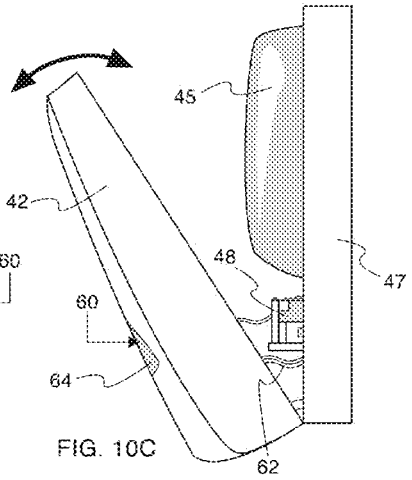
FIG. 10C shows a side view of one embodiment of an external fluid dispenser which may include a cover, a base plate, a fluid container, a dispenser mechanism and a sensor.

FIG. 10C shows a side view of one embodiment of external fluid dispenser 40 which may include cover 42, base plate 47, fluid container 45, dispenser mechanism 48 and sensor 60. FIG. 10C shows one embodiment of external fluid dispenser 40 partially positioned away from base plate 47. In one or more embodiments, some or all of cover 42 may be configured to be repeatedly removable, detachable and/or positioned away from base plate 47 and restored to its previous positioning. For example, in one or more embodiments, cover 42 may be removed, detached or positioned away from base plate 47 to reveal various aspects of external fluid dispenser 40 (such as, for example, but not limited to fluid container 45, dispenser mechanism 48 and power source 49 (not shown in FIG. 10C)). In one or more embodiments, once cover 42 may be partially or fully removed, detached or positioned away from base plate 47, a user may remove fluid container 45, replace the batteries associated with power source 49 and/or perform other maintenance, repair and/or other functions desired.

Figure 10D:
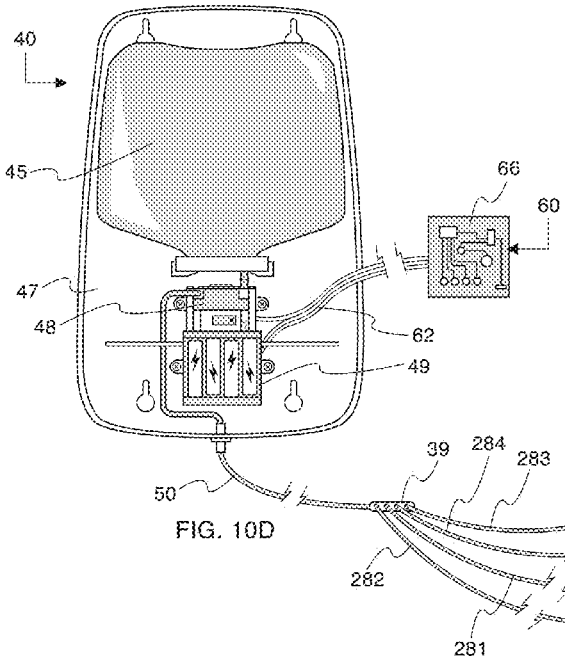
FIG. 10D shows a front view of one embodiment of aspects of an external fluid dispenser which may include a base plate, a fluid container, a dispenser mechanism, a power source, and a sensor.

FIG. 10D shows a front view of one embodiment of aspects of external fluid dispenser 40 which may include base plate 47, fluid container 45, dispenser mechanism 48, power source 49, and sensor 60. FIG. 10D also shows aspects of the flow way which may include external tubing member 50, connector member 39, internal tubing members 281, 282, 283 and 284, and nozzles 301, 302, 303 and 304. In one or more embodiments, sensor 60 may include front side 64 (not shown in FIG. 10D), back side 66 and means 62 (such as, for example, but not limited to for wires) for communicating with aspects of toilet seat cleaning system 10, such as, for example, but not limited to dispenser mechanism 48 and/or power source 49. In one or more embodiments, fluid container 45 may include various configurations. For example, in one or more embodiments, fluid container 45 may include a bladder which may be capable of containing various amounts of fluid (such as, for example, but not limited to over about 1000 mL of fluid and/or between about 900 mL to about 3,000 mL of fluid) and communicating said fluid. In one or more embodiments, each fluid container 45 may be configured to provide over about 1000 wipes and/or between about 1,000 to about 4,000 wipes before refilling and/or replacement is necessary. In one or more embodiments, dispenser mechanism 48 and/or power source 49 may be configured to base plate 47. In one or more embodiments, fluid container 45 may be configured to dispenser mechanism 48 and base plate 47. In one or more embodiments, external tubing member 50 may be configured to dispenser mechanism 48. In one or more embodiments, external tubing member 50 may be configured to connector member 39. In one or more embodiments, connector member 39 may be configured to internal tubing member 281, 282, 283 and 284, each of which may be configured to one of the nozzles 301, 302, 303 and 304. In one or more embodiments, although not shown in FIG. 10D, each of the nozzles 301, 302, 303 and 304 may be configured to one of the openings 261, 262, 263 and 264.

Figure 10E:
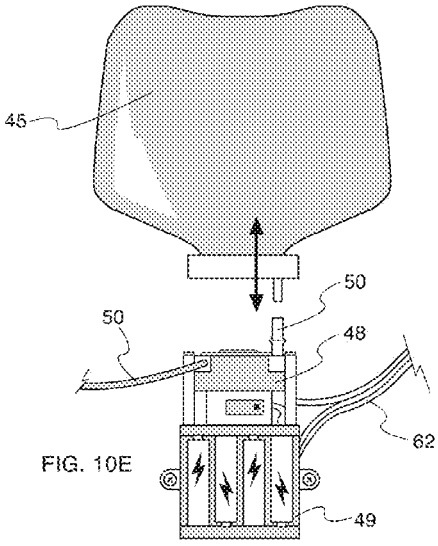
FIG. 10E shows aspects of one embodiment of a fluid container, a dispenser mechanism, a power source, an external tubing member and a means for communication between a sensor and other aspects of the toilet seat cleaning system.

FIG. 10E shows aspects of one embodiment of fluid container 45, dispenser mechanism 48, power source 49, external tubing member 50 and means 62. In one or more embodiments, fluid container 45 may be releasably configured to external tubing member 50. In one or more embodiments, fluid container 45 may be refillable, reusable and/or replaceable. In one or more embodiments, when fluid container 45 is configured to external tubing member 50 and when dispenser mechanism 48 is activated, fluid may flow from fluid container 45, through external tubing member 50 and ultimately out openings 261, 262, 263 and 264 and onto at least one surface on toilet seat 20.

Figure 10F:
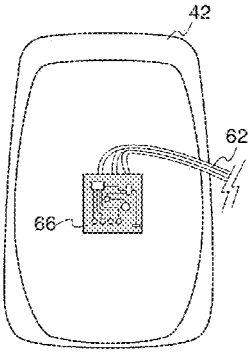
FIG. 10F shows a rear view of one embodiment of a sensor and a cover.

FIG. 10F shows a rear view of one embodiment of sensor 60 and cover 42 wherein sensor 60 is configured to the back of cover 42. Although sensor 60 is shown in FIG. 10F to be configured to cover 42, in one or more embodiments, sensor 60 may be configured to different surfaces of cover 42 and/or on a wall or some other surface. In one or more embodiments, sensor 60 may be configured to external fluid dispenser wirelessly. Although sensor 60 is shown in FIG. 10F to be square in shape, in one or more embodiments, sensor 60 could be circular in form, much smaller.

Figure 11A:
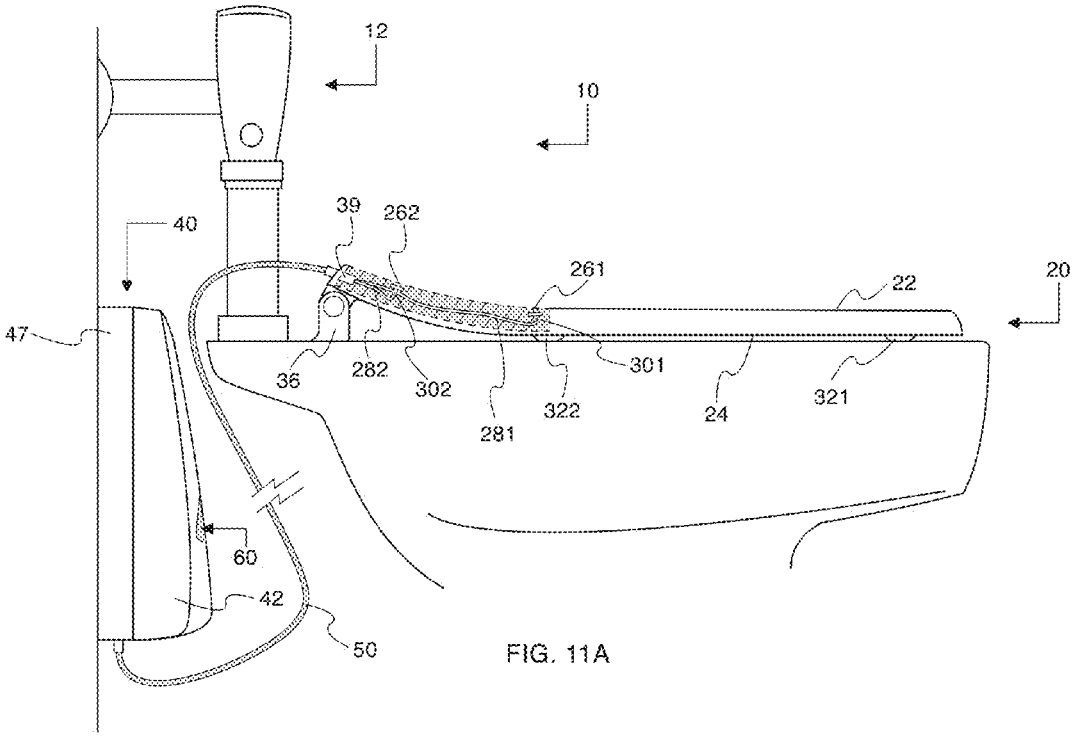
FIG. 11A shows a side view of one embodiment of aspects of a toilet seat cleaning system including aspects of a toilet, a toilet seat, a flow way and an external fluid dispenser.

FIG. 11A shows a side view of one embodiment of aspects of toilet seat cleaning system 10 including aspects of toilet 12, toilet seat 20, the flow way and external fluid dispenser 40. FIG. 11A shows a cut away of a portion of toilet seat 20 which reveals one embodiment of aspects of the flow way including internal tubing members 281, 282, 283 (not shown in FIG. 11A) and 284 (not shown in FIG. 11A), nozzle 301, 302, 303 (not shown in FIG. 11A) and 304 (not shown in FIG. 11A), connector member 39 and external tubing member 50. The cut away also shows one embodiment of openings 261, 262, 263 (not shown in FIG. 11A) and 264 (not shown in FIG. 11A). Although FIG. 11A shows the external fluid dispenser 40 located behind toilet 12 on a wall, in one or more embodiment, external fluid dispenser 40 may be located in various positions and/or surfaces. In one or more embodiments, various toilets other than toilet 12 may be used.

Figure 11B:
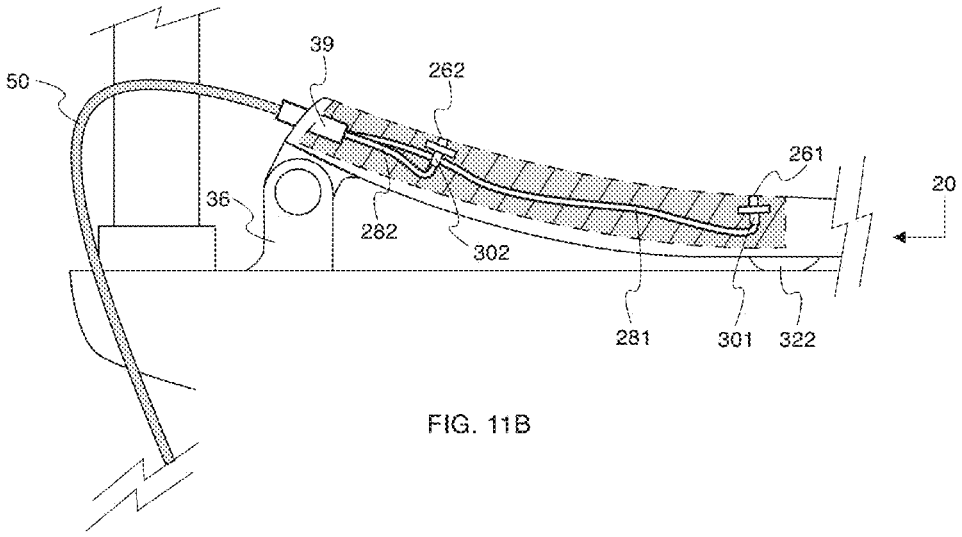
FIG. 11B shows an exploded side view of a portion of the embodiment of the toilet seat, the flow way and the toilet as illustrated in FIG. 11A.

FIG. 11B shows an exploded side view of a portion of the embodiment of the toilet seat 20, the flow way and toilet 12 as illustrated in FIG. 11A.

FIGS. 12A and 12B show various embodiments of toilet seat cleaning system 10 which may include various toilets, a toilet seat 201, an internal fluid dispenser 70 (not shown in FIGS. 12A and 12B), a flow way (not shown in FIGS. 12A and 12B), a cap 72 and sensor 60.

In one or more embodiments, the embodiments of toilet seat cleaning system 10 illustrated in FIGS. 12A and 12B may be similar to the embodiments illustrated in FIGS. 1, 7A, 7B and 7C. For example, in one or more embodiments, toilet seat 201 may include openings 261, 262, 263 and 264 (although four openings are shown in FIGS. 12A and 12B more or less openings may be provided). In one or more embodiments, internal fluid dispenser 70 may include the capacity to contain and communicate fluid (not shown in FIGS. 12A and 12B). In one or more embodiments, the flow way may be configured to allow fluid to flow from internal fluid dispenser 70 and ultimately out of toilet seat's 201 openings 261, 262, 263 and 264 and on to at least one surface of toilet seat 201.

In one or more embodiments, the embodiments of toilet seat cleaning system 10 illustrated in FIGS. 12A and 12B may be different than the embodiments illustrated in FIGS. 1, 7A, 7B and 7C. For example, in one or more embodiments, one difference between the embodiments of toilet seat cleaning system 10 illustrated in FIGS. 12A and 12B as compared to the embodiments illustrated in FIGS. 1, 7A, 7B and 7C, may be that the embodiments illustrated in FIGS. 1, 7A, 7B and 7C include an external source of fluid (such as, for example, but not limited to external fluid dispenser 40) whereas the embodiments illustrated in FIGS. 12A and 12B include an source of fluid that may be, at least in part, built into toilet seat 201 (such as, for example, but not limited to internal fluid dispenser 70). In one or more embodiments, another difference between the embodiments of toilet seat cleaning system 10 illustrated in FIGS. 12A and 12B as compared to the embodiments illustrated in FIGS. 1, 7A, 7B and 7C, may be that the embodiments illustrated in FIGS. 1, 7A, 7B and 7C may include the sensor 60 that is configured on the fluid dispenser whereas the embodiments of toilet seat cleaning system 10 illustrated in FIGS. 12A and 12B may include the sensor 60 that may be configured to an adjacent or proximal wall, fixture or other surface separate from the fluid dispenser.

FIG. 12A shows one embodiment of toilet seat cleaning system 10 which may include toilet 11, toilet seat 201, internal fluid dispenser 70 (not shown in FIG. 12A), cap 72, and sensor 60. In one or more embodiments, toilet 11 may be used in a residential setting and include a conventional tank, toilet bowel and other parts associated with such a system. Although FIG. 12A does not show toilet seat 201 including a lid, in one or more embodiments toilet seat 201 may be configured with a lid.

FIG. 12B shows one embodiment of toilet seat cleaning system 10 which may include toilet 12, toilet seat 201, internal fluid dispenser 70 (not shown in FIG. 12B), cap 72, and sensor 60. In one or more embodiments, toilet 12 may be used in a commercial setting and include tankless functionality, a toilet bowel and other parts associated with such a system.

Although not shown in any illustration herein, in one or more embodiments, toilet seat cleaning system 10 which may include toilet seat 201 and internal fluid dispenser 70 may also include toilet 13 which may be configured as a portable toilet (such as, for example, but not limited to a Porta-Potty, etc.) that may include certain parts associated with such a system.

Figure 13A:
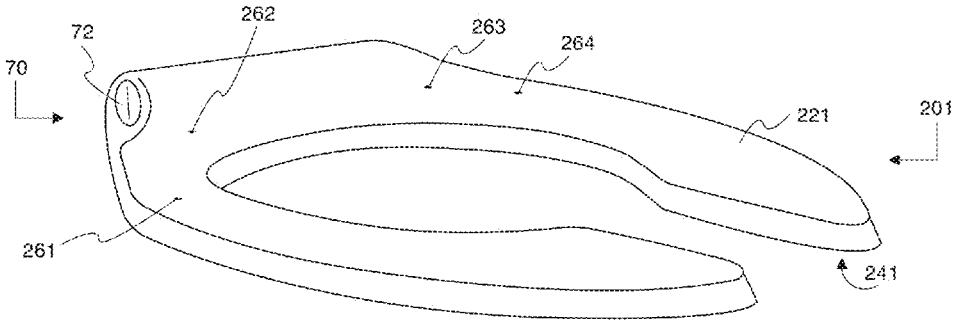
FIG. 13A is a perspective view of one embodiment of a toilet seat which may include a top surface, a bottom surface (not shown in FIG. 13A), an internal fluid dispenser (not shown in FIG. 13A), openings and a cap.

FIG. 13A is a perspective view of one embodiment of toilet seat 201 which may include a top surface 221, a bottom surface 241 (not shown in FIG. 13A), openings 261, 262, 263 and 264 and cap 72.

Figure 13B:
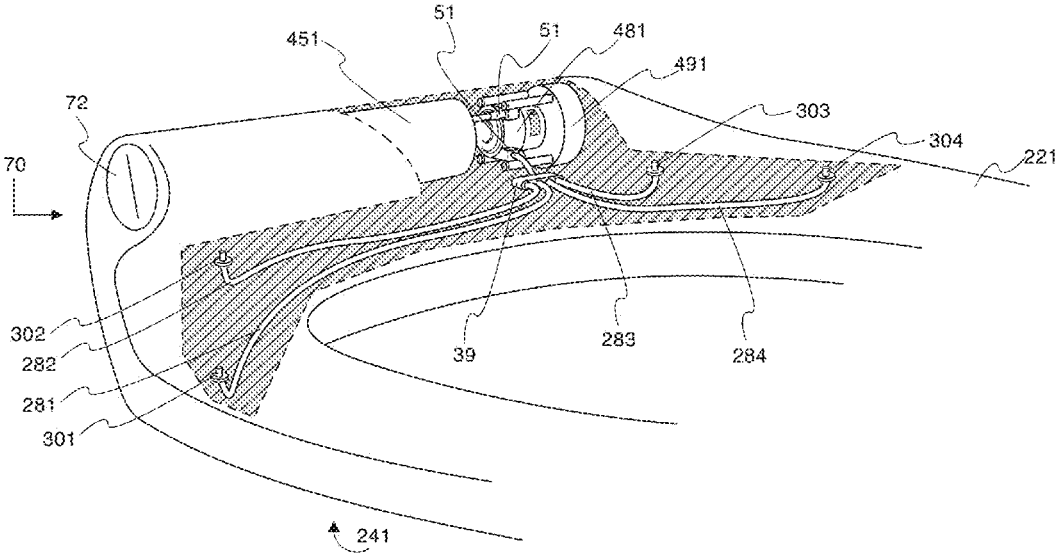
FIG. 13B is an exploded perspective view of a portion of the embodiment of the toilet seat as illustrated in FIG. 13A including a cut away of its top surface revealing one embodiment of aspects of an internal fluid dispenser and a flow way.

FIG. 13B is an exploded perspective view of a portion of the embodiment of toilet seat 201 as illustrated in FIG. 13A including a cut away of top surface 221 revealing one embodiment of aspects of toilet seat 201, internal fluid dispenser 70, and of the flow way. In one or more embodiments, internal fluid dispenser 70 may include a fluid container 451, a dispenser mechanism 481, and a power source 491. In one or more embodiments, aspects of the configuration of the flow way illustrated in FIG. 13B may be similar to and/or different than aspects of the configuration of the flow ways illustrated in FIGS. 2B and 8B.

In one or more embodiments, the flow way as illustrated in FIG. 13B may include internal tubing members 281, 282, 283 and 284 (although four internal tubing members are shown in FIG. 13B more or less internal tubing members may be provided); nozzles 301, 302, 303 and 304 (although four nozzles are shown in FIG. 13B more or less nozzles may be provided); connector member 39 (although one connector member is shown in FIG. 13B more or less connector members may be provided); and internal connector tubing member 51 (although one internal connector tubing member is shown in FIG. 13B more or less internal connector tubing members may be provided).

In one or more embodiments, fluid container 451 may be configured to internal connector tubing member 51. In one or more embodiments, internal connector tubing member 51 may be configured to connector member 39. In one or more embodiments, connector member 39 may be configured to one or more of the internal tubing members 281, 282, 283 and 284. In one or more embodiments, each of the internal tubing members 281, 282, 283 and 284 may be configured to one of the nozzles 301, 302, 303 and 304 and each nozzle may be configured to one of the openings 261, 262, 263 and 264 (openings not shown in FIG. 13B). For example, in one or more embodiments, internal tubing member 281 may be configured to nozzle 301 and nozzle 301 may be configured to opening 261 (not shown on FIG. 13B); internal tubing member 282 may be configured to nozzle 302 and nozzle 302 may be configured to opening 262 (not shown on FIG. 13B); internal tubing member 283 may be configured to nozzle 303 and nozzle 303 may be configured to opening 263 (not shown on FIG. 13B); and internal tubing member 284 may be configured to nozzle 304 and nozzle 304 may be configured to opening 264 (not shown on FIG. 13B).

Figure 14:
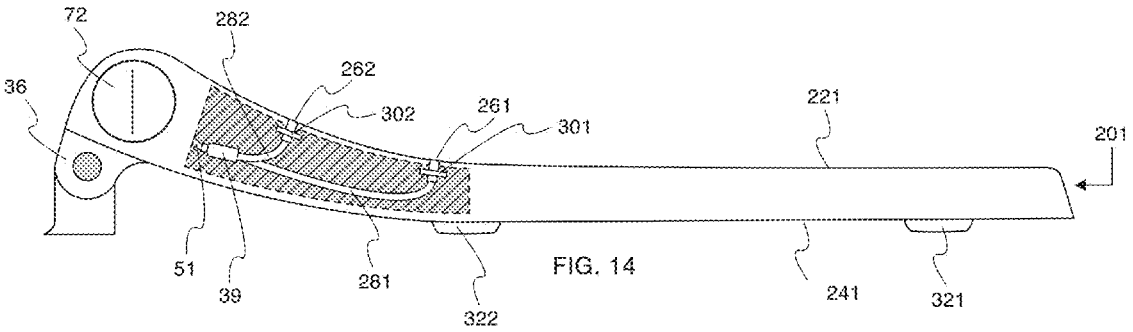
FIG. 14 shows a side view of one embodiment of aspects of a toilet seat cleaning system including aspects of a toilet seat, a flow way and a cap.

FIG. 14 shows a side view of one embodiment of aspects of toilet seat cleaning system 10 including aspects of the flow way and cap 72. FIG. 14 shows a cut away of a portion of toilet seat 201 which reveals one embodiment of aspects of the flow way including internal tubing members 281, 282, 283 (not shown in FIG. 14) and 284 (not shown in FIG. 14), nozzle 301, 302, 303 (not shown in FIG. 14) and 304 (not shown in FIG. 14), connector member 39 and internal connector tubing member 51. The cut away also shows one embodiment of openings 261, 262, 263 (not shown in FIG. 14) and 264 (not shown in FIG. 14). FIG. 14 shows one embodiment of means 36 for articulating toilet seat 201. In one or more embodiments, although FIG. 14 (and elsewhere) shows the means 36 for articulating toilet seat 201 comprising a cylindrical shaped configuration, any configuration designed to allow toilet seat 201 to articular may suffice (such as, for example, but not limited to a hinge or other means).

Figure 15A:
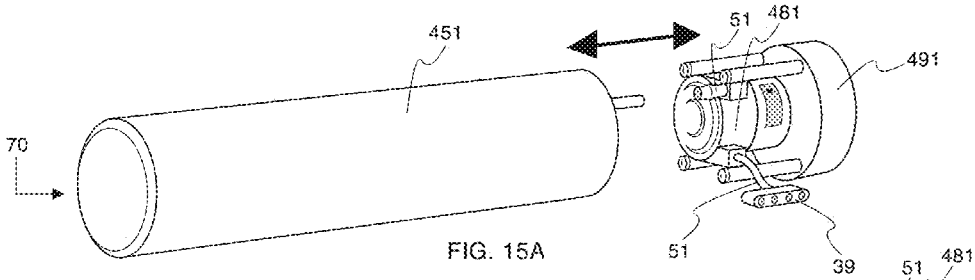
FIG. 15A shows a perspective view of one embodiment of aspects of an internal fluid dispenser which may include a fluid container, a dispenser mechanism, and a power source.
Figure 15B:
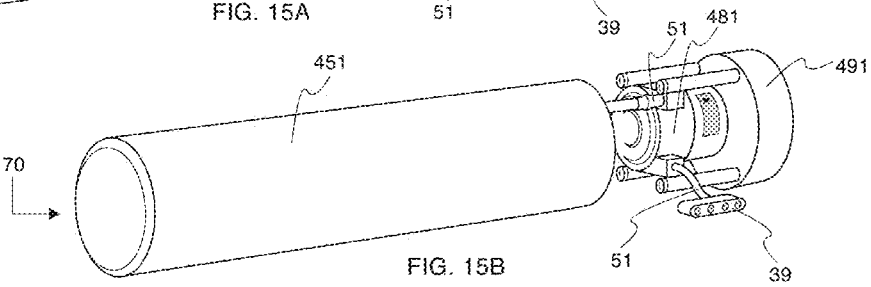
FIG. 15B shows a perspective view of the embodiment of the internal fluid dispenser illustrated in FIG. 15A albeit its fluid container is configured to an internal connector tubing member.

FIGS. 15A and 15B show one or more embodiments of various aspects of internal fluid dispenser 70. In one or more embodiments, the various aspects of fluid dispensers described herein may apply to internal fluid dispensers. For example, in one or more embodiments, aspects of internal fluid dispenser 70 (such as, but not limited to dispenser mechanism 481) may communicate with sensor 60 which, when activated, may initiate electronical signals or other communications which trigger mechanical actions which may influence fluid being communicated out of the internal fluid dispenser 70 and ultimately out of openings 261, 262, 263 and 264 and onto at least one surface of toilet seat 201.

FIG. 15A shows a perspective view of one embodiment of aspects of internal fluid dispenser 70 which may include fluid container 451, dispenser mechanism 481, and power source 491. In one or more embodiments, aspects of internal fluid dispenser 70 may be configured to various dimensions. For example, in one or more embodiments, fluid container 451 may be configured to about 6 inches long and between about ¼ of an inch to about 12 inches in diameter (such as, for example, but not limited to about 2 inches in diameter). Although FIG. 15A (and elsewhere) shows one embodiment of fluid container 451 in substantially a tubular shape, various shapes may be implemented. In one or more embodiments, fluid container 451 may be capable of containing various amounts of fluid (such as, for example, but not limited to over about 1000 mL of fluid and/or between about 200 mL to about 1,500 mL of fluid) and communicating said fluid. In one or more embodiments, each fluid container 451 may be configured to provide over about 1000 wipes and/or between about 100 to about 2,000 wipes before refilling and/or replacement is necessary. In one or more embodiments, fluid container 451 may be refillable, reusable and/or replaceable. In one or more embodiments, fluid container 451 may be releasably configured to internal connector tubing member 51. In one or more embodiments, internal connector tubing member 51 may be configured to connector member 39. In one or more embodiments, when fluid container 451 is configured to internal connector tubing member 51 and when dispenser mechanism 481 is activated, fluid may flow from fluid container 451, through internal connector tubing member 51 and ultimately out openings 261, 262, 263 and 264 and onto at least one surface on toilet seat 201.

In one or more embodiments, dispenser mechanism 481 may be releasably configured to power source 491 by various means (such as, for example, but not limited to screws, bolts and the like or other means) or non-releasably configured to power source 491 by various means (such as, for example, but not limited to melting, adhesion, molding, welding and the like or other means).

FIG. 15B shows a perspective view of the embodiment of internal fluid dispenser 70 illustrated in FIG. 15A albeit fluid container 451 is configured to internal connector tubing member 51.

Figure 15C:
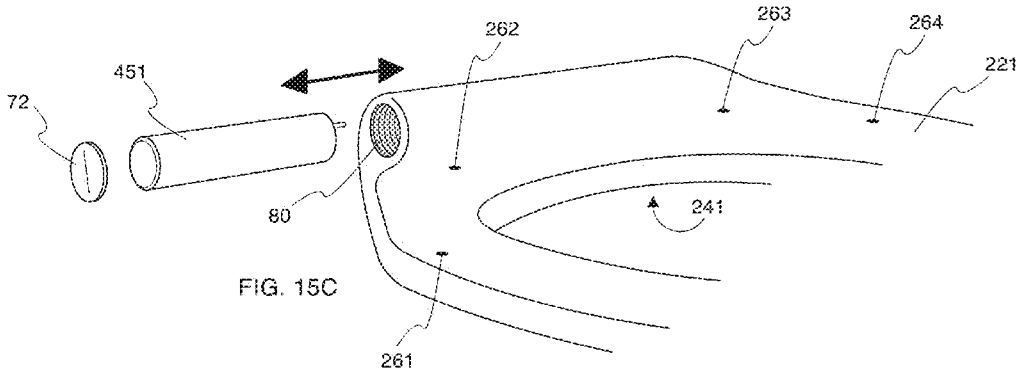
FIG. 15C shows one embodiment of a toilet seat configured with a chamber.

FIG. 15C shows one embodiment of toilet seat 201 configured with a chamber 80. As illustrated in FIGS. 13B and 15C, in one or more embodiments, chamber 80 may be configured to house aspects of internal fluid dispenser 70 (such as, for example, but not limited to fluid container 451, dispenser mechanism 481, and power source 491). Although FIG. 15C (and elsewhere) shows one embodiment of chamber 80 in substantially a tubular shape, various shapes may be implemented. In one or more embodiments, chamber 80 may be configured to allow a user to access and/or remove fluid container 451 from chamber 80. In one or more embodiments, a user may wish to remove fluid container 451 from chamber 80 in order to refill, repair and/or replace fluid chamber 451 or some other aspect of internal fluid dispenser 70, chamber 80 and/or toilet seat 201. FIG. 15C also shows one embodiment of toilet seat cleaning system 10 including cap 72. In one or more embodiments, cap 72 which may be releasably configured to toilet seat 201 by various means (such as, for example, but not limited to screws, bolts, twisting, screwing, snapping, or clipping cap 72 into place and the like or other means). In one or more embodiments, cap 72 may prevent access to and/or prevent movement of fluid container 451 while fluid container 451 is loaded in chamber 80 and cap 72 is properly put in place. In one or more embodiments, cap 72 may be removed and a user may gain access to fluid container 451 or to other aspects of internal fluid dispenser 70, chamber 80 or toilet seat 201 to perform various tasks (such as, for example, but not limited to maintenance, repairs, or other tasks).

Figure 15D:
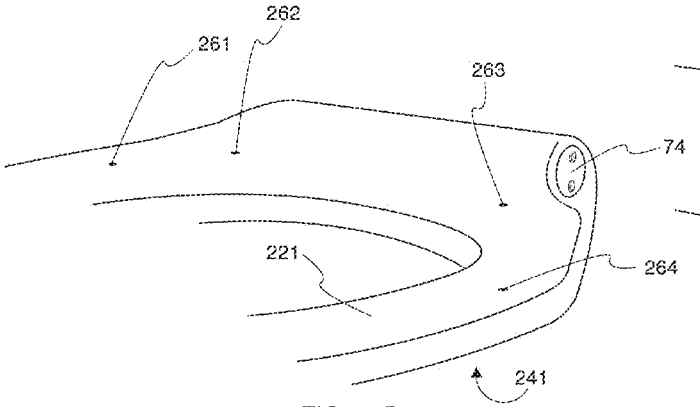
FIG. 15D shows one embodiment of aspects of a toilet seat cleaning system configured with a cap.

FIG. 15D shows one embodiment of aspects of toilet seat cleaning system 10 being configure with a cap 74. Although cap 74 and cap 72 are shown in FIGS. 15C and 15D (and elsewhere) to be circular in form, they may be configured in others shape as desired.

Figure 15E:
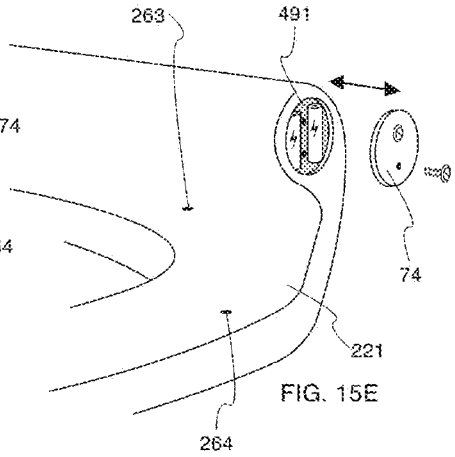
FIG. 15E shows one embodiment of a cap removed from a toilet seat cleaning system and exposing aspects of a power source.

FIG. 15E shows one embodiment of cap 74 removed from toilet seat cleaning system 10 and exposing aspects of power source 491. In one or more embodiments, cap 74 may be releasably configured to toilet seat 201 and/or power source 491 by various means (such as, for example, but not limited to screws, bolts, twisting, screwing, snapping, or clipping cap 74 into place and the like or other means). In one or more embodiments, cap 74 may prevent access to and/or prevent movement of power source 491 and/or its components (such as, for example, but not limited to batteries) when cap 74 is properly in place. In one or more embodiments, cap 74 may be removed and a user may gain access to power source 491 or to other aspects of internal fluid dispenser 70, chamber 80 or toilet seat 201 to perform various tasks (such as, for example, but not limited to change out batteries, maintenance, repairs, or other tasks). As indicated above, in one or more embodiments, power source 491 may include batteries of various shapes, sizes, types, capacities and other dimensions and/or characteristics.

Figure 16A:
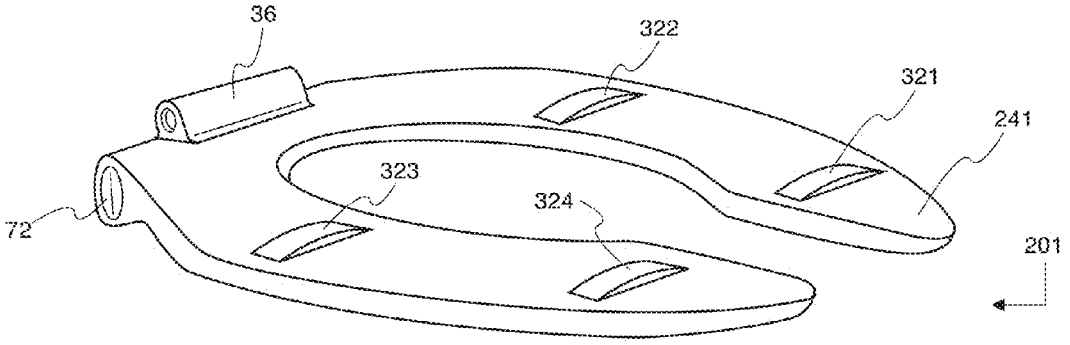
FIG. 16A shows a perspective view of one embodiment of a bottom surface of a toilet seat which may include support members and means for articulating the toilet seat.

FIG. 16A shows a perspective view of one embodiment of the bottom surface 241 of toilet seat 201 which may include support members 321, 322, 323 and 324 (although four support members are shown in FIG. 16A more or less support members of various shapes and comprising various features may be provided) and means 36 for articulating toilet seat 201. Although FIG. 16A does not show a compartment door (such as, for example, but not limited to compartment door 34) or a compartment (such as, for example, but not limited to compartment 38), in one or more embodiments, such may be provided. In such an instance, in one or more embodiments, the depth, width, length and other dimensions and features of compartment door 34 and/or compartment 38 may vary depending on the size of the toilet seat, other parts used and/or other reasons.

Although some of the embodiments illustrated in FIGS. 1 through 11B show various embodiments of toilet seat cleaning system 10 configured with a compartment door (such as, for example, but not limited to compartment door 34) and/or a compartment (such as, for example, but not limited to compartment 38), in one or more embodiments, the embodiments illustrated in FIGS. 1 through 11B may be configured without a compartment door (such as, for example, but not limited to compartment door 34) and/or a compartment (such as, for example, but not limited to compartment 38).

Figure 16B:
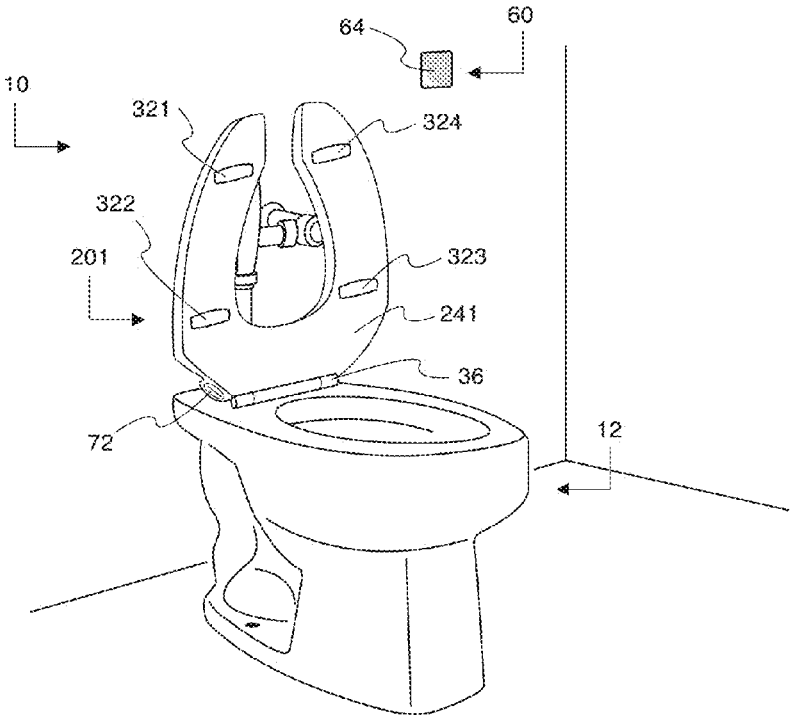
FIG. 16B shows one embodiment of a bottom surface of a toilet seat in upright position.

FIG. 16B shows one embodiment of bottom surface 241 of toilet seat 201 in upright position.

FIGS. 17A, 17B, 17C, 17D, 17E, 17F, 17G, 17H, 17I, 17J, 17K and 17L, show various embodiments of toilet seat 20 configured with various numbers of openings in various locations on the respective top surfaces 22 of the embodied toilet seats, wherein fluid (such as, for example, but not limited to fluid 90) may be communicated out of said openings and engaged by a user to clean the embodied toilet seats. Although FIGS. 17A through 17L show various embodiments of toilet seat 20, in one or more embodiments, toilet seat 201 may be modified to be similarly configured and used.

Figures 17A, 17B, 17C, 17D, 17E, 17F, 17G, 17H, 17I, 17J, 17K, 17L:
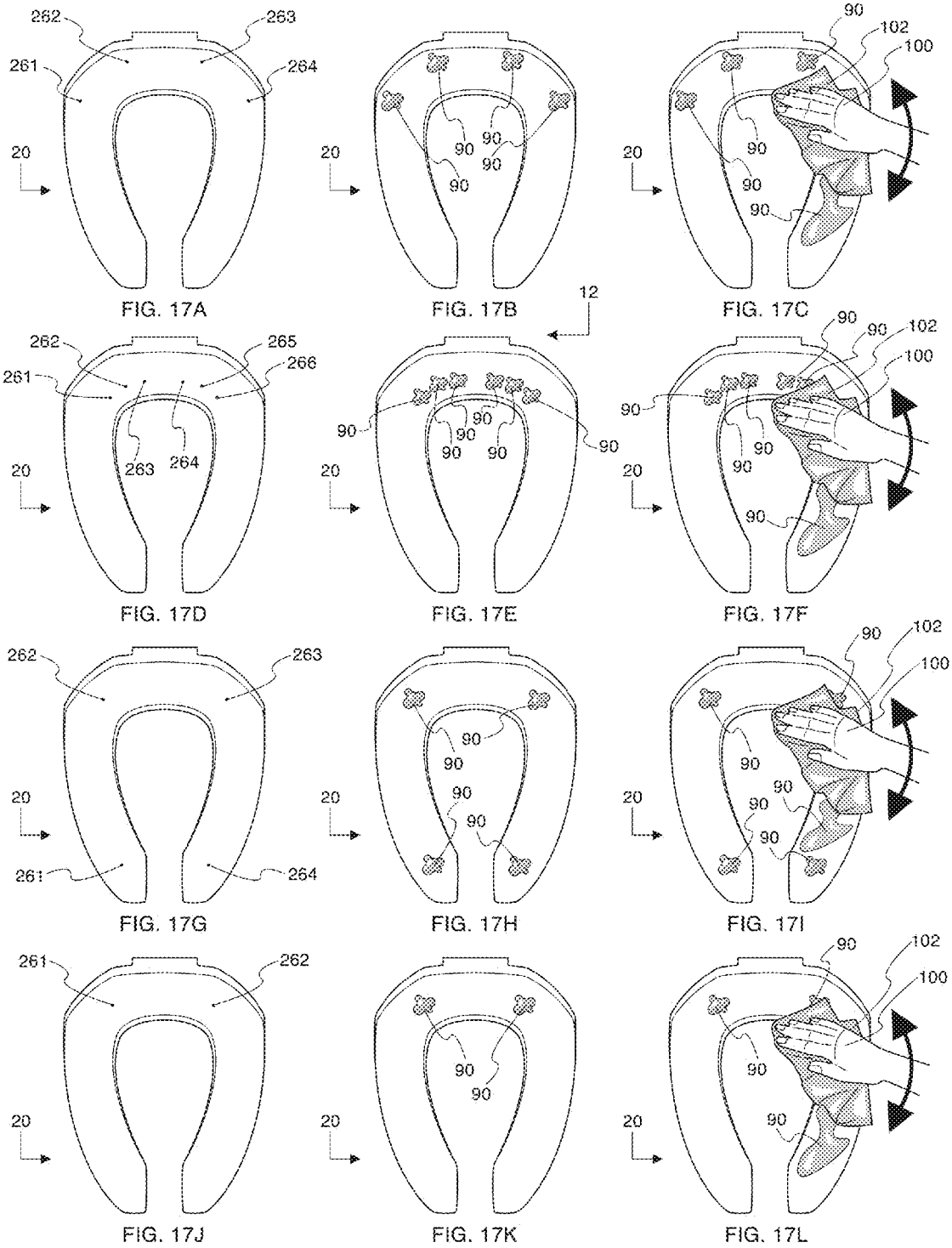
FIG. 17A shows one embodiment of a toilet seat including four openings.
FIG. 17B shows the embodiment of the toilet seat as illustrated in FIG. 17A wherein fluid has been communicated out of the four openings.
FIG. 17C shows the embodiment of the toilet seat as illustrated in FIG. 17B wherein a user's hand is engaging an object in an effort to clean the toilet seat.
FIG. 17D shows one embodiment of a toilet seat including six openings.
FIG. 17E shows the embodiment of the toilet seat as illustrated in FIG. 17D wherein fluid has been communicated out of the six openings.
FIG. 17F shows the embodiment of the toilet seat as illustrated in FIG. 17E wherein a user's hand is engaging an object in an effort to clean the toilet seat.
FIG. 17G shows one embodiment of a toilet seat including four openings.
FIG. 17H shows the embodiment of the toilet seat as illustrated in FIG. 17G wherein fluid has been communicated out of the four openings.
FIG. 17I shows the embodiment of the toilet seat as illustrated in FIG. 17H wherein a user's hand is engaging an object in an effort to clean the toilet seat.
FIG. 17J shows one embodiment of a toilet seat including two openings.
FIG. 17K shows the embodiment of the toilet seat as illustrated in FIG. 17J wherein fluid has been communicated out of the two openings.
FIG. 17L shows the embodiment of the toilet seat as illustrated in FIG. 17K wherein a user's hand is engaging an object in an effort to clean the toilet seat.

FIG. 17A shows one embodiment of toilet seat 20 including four openings (i.e. openings 261, 262, 263 and 264).

FIG. 17B shows the embodiment of toilet seat 20 as illustrated in FIG. 17A wherein fluid 90 has been communicated out of the four openings (i.e. openings 261, 262, 263 and 264).

FIG. 17C shows the embodiment of toilet seat 20 as illustrated in FIG. 17B wherein a user's hand 100 is engaging an object 102 (such as, for example, but not limited to toilet paper, tissue, napkin, towel, cloth and the like and other means) to wipe the fluid 90 communicated out of the four openings (i.e. openings 261, 262, 263 and 264) in an effort to clean the toilet seat.

FIG. 17D shows one embodiment of toilet seat 20 including six openings (i.e. openings 261, 262, 263, 264, 265 and 266).

FIG. 17E shows the embodiment of toilet seat 20 as illustrated in FIG. 17D wherein fluid 90 has been communicated out of the six openings (i.e. openings 261, 262, 263, 264, 265 and 266).

FIG. 17F shows the embodiment of toilet seat 20 as illustrated in FIG. 17E wherein a user's hand 100 is engaging an object 102 (such as, for example, but not limited to toilet paper, tissue, napkin, towel, cloth and the like and other means) to wipe the fluid 90 communicated out of the six openings (i.e. openings 261, 262, 263, 264, 265 and 266) in an effort to clean the toilet seat.

FIG. 17G shows one embodiment of toilet seat 20 including four openings (i.e. openings 261, 262, 263 and 264).

FIG. 17H shows the embodiment of toilet seat 20 as illustrated in FIG. 17G wherein fluid 90 has been communicated out of the four openings (i.e. openings 261, 262, 263 and 264).

FIG. 17I shows the embodiment of toilet seat 20 as illustrated in FIG. 17H wherein a user's hand 100 is engaging an object 102 (such as, for example, but not limited to toilet paper, tissue, napkin, towel, cloth and the like and other means) to wipe the fluid 90 communicated out of the four openings (i.e. openings 261, 262, 263 and 264) in an effort to clean the toilet seat.

FIG. 17J shows one embodiment of toilet seat 20 including two openings (i.e. openings 261 and 262).

FIG. 17K shows the embodiment of toilet seat 20 as illustrated in FIG. 17J wherein fluid 90 has been communicated out of the two openings (i.e. openings 261 and 262).

FIG. 17L shows the embodiment of toilet seat 20 as illustrated in FIG. 17K wherein a user's hand 100 is engaging an object 102 (such as, for example, but not limited to toilet paper, tissue, napkin, towel, cloth and the like and other means) to wipe the fluid 90 communicated out of the two openings (i.e. openings 261 and 262) in an effort to clean the toilet seat.

Figure 18:
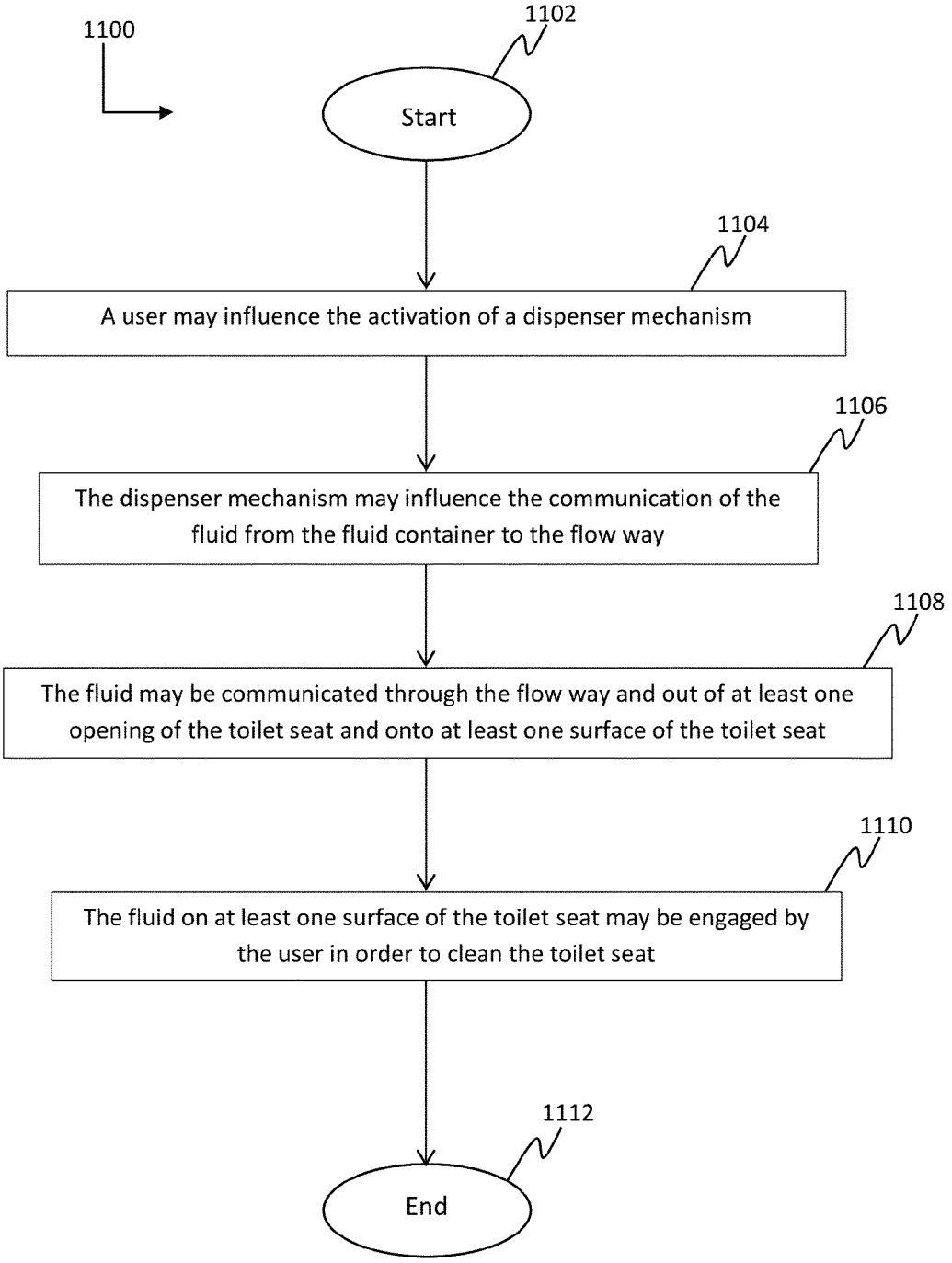
FIG. 18 is a flow diagram that depicts one embodiment of a method for using at least one toilet seat cleaning system.

FIG. 18 is a flow diagram that depicts one embodiment of a method 1100 for using at least one toilet seat cleaning system (such as, for example, but not limited to toilet seat cleaning system 10).

In one or more embodiment, in step 1102, a user may enter method 1100 by approaching a toilet seat cleaning system which may include a toilet (such as, for example, but not limited to toilets 11, 12 or 13), a toilet seat (such as, for example, but not limited to toilet seats 20 or 201), a fluid dispenser (such as, for example, but not limited to external fluid dispenser 40 or internal fluid dispenser 70) and a flow way. In one or more embodiments, the toilet seat may include at least one opening (such as, for example, but not limited to openings 261, 262, 263 and 264) and at least one surface (such as, for example, but not limited to top surfaces 22 or 221). In one or more embodiments, the fluid dispenser may include a fluid container (such as, for example, but not limited to fluid container 45 or 451) which may contain fluid (such as, for example, but not limited to fluid 90) and a dispenser mechanism (such as, for example, but not limited to dispenser mechanism 48 or 481).

In one or more embodiments, at step 1104, the user may influence the activation of the dispenser mechanism. As indicated above, in one or more embodiments, the dispenser mechanism may be activated by a user (such as, for example, but not limited to a user pumping, pushing, pulling, pressing, pinching, shaking, and/or other manual operations) and/or by at least one sensor (such as, for example, but not limited to sensor 60).

In one or more embodiments, at step 1106, the dispenser mechanism may influence the communication of the fluid from the fluid container to the flow way.

In one or more embodiments, at step 1108, the fluid may be communicated through the flow way and out of at least one opening of the toilet seat and onto at least one surface of the toilet seat.

In one or more embodiment, at step 1110, the fluid on at least one surface of the toilet seat may be engaged by the user in order to clean the toilet seat. In one or more embodiments, a user may use various objects to engage the fluid (such as, for example, fluid 90). For example, in one or more embodiments, various objects may include toilet paper, tissue, napkins, towels, cloths, brushes, pads, cleaning instruments, and the like and other means for engaging the fluid. In one or more embodiments, a user may engage the fluid in various ways. For example, in one or more embodiments, various engagement activities may include wiping, spreading, rubbing, scrubbing, brushing, cutting, scraping, and the like and other means for cleaning a toilet seat.

In one or more embodiment, in step 1112, method 1100 may terminate.

Different embodiments of the disclosure may implement the above scenario(s) and/or variations of the above scenario(s). In one or more embodiment, any of the structures, functions, and/or features of any aspect of the disclosure expressly or inherently described or illustrated herein may be combined with any of the structures, functions, and/or features of any other aspect of the disclosure expressly or inherently described or illustrated herein. In one or more embodiments, each component of the disclosures may be provided in any color.

In one or more embodiments, other modifications may be made to the embodiments illustrated in the drawings or otherwise disclosed herein or equivalents, which may include and/or have the capacity to utilize abilities, systems, devices, articles, means, functionality, features, methods and/or uses not expressly and/or impliedly described herein and/or illustrated in the drawings to this application but which may be obvious to one skilled in the art, whether developed later or known at the time of filing.

It should be understood that the present systems, apparatuses, devices, means, methods and structures are not intended to be limited to the particular forms disclosed; rather, they are to cover all combinations, modifications, equivalents, and alternatives. A system, device, article, means, method or structure that is configured in a certain way may be configured in at least that way, but may also be configured in ways that are not described or illustrated. The disclosure may be configured to function with a variety of systems, devices, articles, methods, means, and structures. Different materials may be used for individual components. Different materials may be combined in a single component.

The present disclosure may be embodied in other specific forms without departing from its spirit or essential characteristics. It is appreciated that various features of the above described examples and embodiments may be mixed and matched to form a variety of other combinations and alternatives. It is also appreciated that devices, methods and systems disclosed herein should not be limited simply to toilet seat cleaning devices, methods and systems. The described embodiments are to be considered in all respects as illustrative and not restrictive. Other embodiments and/or implementations are within the scope of the following claims and at least all changes which come within the meaning and range of equivalency of the claims are to be embraced within their scope. The scope of the invention may be indicated by the appended claims rather than by any of the foregoing description.

What is claimed is:

1. A toilet seat, comprising:

at least one surface comprising a top surface;

at least one opening configured on the top surface;

an internal fluid dispenser comprising a fluid container for storing fluid, a dispenser mechanism for influencing the dispensation of fluid out of the fluid container, and a power source for supplying power to the internal fluid dispenser;

a chamber for housing at least the fluid container, wherein the chamber is situated within the toilet seat and is configured such that the fluid container may be removably insertable into the chamber;

a flow way for facilitating the flow of fluid from the internal fluid dispenser, through the flow way, and out of the at least one opening and onto the top surface of the toilet seat, wherein the flow way is operably connected to the at least one opening and the internal fluid dispenser; and a sensor that communicates with the internal fluid dispenser to influence the dispensing of fluid from the internal fluid dispenser; and wherein the toilet seat is capable of being operably connected to a toilet.

2. The toilet seat of claim 1, wherein the toilet seat is configured so that the toilet seat does not require a lid or a cover to be positioned over the toilet seat in order for the toilet seat to be cleaned.

3. The toilet seat of claim 1, wherein the sensor is situated on at least one surface of the toilet seat.

4. The toilet seat of claim 1, further comprising a cap designed to operably connect to the toilet seat and to aid in the securement of the fluid container when the fluid container is situated in the chamber.

5. The toilet seat of claim 1, wherein the toilet seat is configured such that a user may use fluid dispensed by the internal fluid dispenser to manually clean the at least one surface of the toilet seat.

6. The toilet seat of claim 1, wherein the at least one opening comprising at least two openings located on the top surface of the toilet seat.

7. The toilet seat of claim 1, wherein the dispenser mechanism comprising mechanical components for influencing the dispensation of fluid out of the fluid container.

8. The toilet seat of claim 1, wherein the fluid container is replaceable.

9. The toilet seat of claim 1, further comprising:

a compartment where at least one aspect of the flow way is situated; and a compartment door for providing access to at least one aspect of the flow way.

10. The toilet seat of claim 1, wherein the flow way comprising:

at least one nozzle, wherein each at least one nozzle is operably connected to a separate at least one opening;

at least one internal tubing member, wherein each at least one internal tubing member is operably connected to a separate at least one nozzle; and at least one connector member operably connected to the at least one internal tubing member and operably connected to the internal fluid dispenser.

11. The toilet seat of claim 1, wherein the fluid container assumes a substantially tubular shape.

12. The toilet seat of claim 1, wherein the fluid container assumes a shape substantially alternative to a substantially tubular shape.

13. The toilet seat of claim 1 is configured to be operably connected to a toilet used for commercial purposes.

14. A toilet seat cleaning system, comprising:

a toilet seat, a sensor and a toilet;

wherein the toilet seat comprising:

at least one surface comprising a top surface;

at least one opening configured on the top surface;

an internal fluid dispenser comprising a fluid container for storing fluid, a dispenser mechanism for influencing the dispensation of fluid out of the fluid container, and a power source for supplying power to the internal fluid dispenser;

a chamber for housing at least the fluid container, wherein the chamber is situated within the toilet seat and is configured such that the fluid container may be removably insertable into the chamber;

a flow way for facilitating the flow of fluid from the internal fluid dispenser, through the flow way, and out of the at least one opening and onto the top surface of the toilet seat, wherein the flow way is operably connected to the at least one opening and the internal fluid dispenser; and wherein the toilet seat is capable of being operably connected to the toilet; and wherein the sensor communicates with the internal fluid dispenser, wherein when the sensor is activated by a user, the sensor influences the dispensing of fluid from the internal fluid dispenser.

15. The toilet seat cleaning system of claim 14, wherein the toilet seat further comprising:

a compartment where at least one aspect of the flow way is situated; and a compartment door for providing access to at least one aspect of the flow way.

16. The toilet seat cleaning system of claim 14, wherein the flow way comprising:

at least one nozzle, wherein each at least one nozzle is operably connected to a separate at least one opening;

at least one internal tubing member, wherein each at least one internal tubing member is operably connected to a separate at least one nozzle; and at least one connector member operably connected to the at least one internal tubing member and operably connected to the internal fluid dispenser.

17. A method of using a toilet seat, wherein the toilet seat, comprising:

at least one surface comprising a top surface;

at least one opening configured on the top surface;

an internal fluid dispenser comprising a fluid container for storing fluid, a dispenser mechanism for influencing the dispensation of fluid out of the fluid container, and a power source for supplying power to the internal fluid dispenser;

a chamber for housing at least the fluid container, wherein the chamber is situated within the toilet seat and is configured such that the fluid container may be removably insertable into the chamber;

a flow way for facilitating the flow of fluid from the internal fluid dispenser, through the flow way, and out of the at least one opening and onto the top surface of the toilet seat, wherein the flow way is operably connected to the at least one opening and the internal fluid dispenser; and a sensor that communicates with the internal fluid dispenser to influence the dispensing of fluid from the internal fluid dispense; and wherein the toilet seat is capable of being operably connected to a toilet; and wherein the method of using the toilet seat, comprising:

activating the sensor in order to influence the dispensing of fluid from the internal fluid dispenser, through the flow way, and out of the at least one opening and onto the top surface of the toilet seat; and manually cleaning the at least one surface of the toilet seat with the dispensed fluid.

* * * * *